US009941648B2

(12) United States Patent
Ziobro

(10) Patent No.: US 9,941,648 B2
(45) Date of Patent: Apr. 10, 2018

(54) ANGLE BRACKET SYSTEM WITH INTEGRAL GROUND ATTACHMENT

(71) Applicant: David J. Ziobro, Fayetteville, GA (US)

(72) Inventor: David J. Ziobro, Fayetteville, GA (US)

( * ) Notice: Subject to any disclaimer, the term of this patent is extended or adjusted under 35 U.S.C. 154(b) by 0 days.

(21) Appl. No.: 15/149,094

(22) Filed: May 7, 2016

(65) Prior Publication Data

US 2016/0329670 A1 Nov. 10, 2016

Related U.S. Application Data

(60) Provisional application No. 62/158,123, filed on May 7, 2015.

(51) Int. Cl.

| | |
|---|---|
| ***H01R 13/648*** | (2006.01) |
| ***H01R 25/00*** | (2006.01) |
| ***H01R 13/652*** | (2006.01) |
| ***H01R 24/78*** | (2011.01) |
| *H01R 103/00* | (2006.01) |

(52) U.S. Cl.

CPC ..... *H01R 25/006* (2013.01); *H01R 13/652* (2013.01); *H01R 24/78* (2013.01); *H01R 2103/00* (2013.01)

(58) Field of Classification Search

CPC ..... H01R 26/006
USPC ..... 439/106, 107
See application file for complete search history.

(56) References Cited

U.S. PATENT DOCUMENTS

| | | | | |
|---|---|---|---|---|
| 671,486 | A * | 4/1901 | Laumann | A45C 1/12 232/39 |
| 4,017,137 | A * | 4/1977 | Parks | H01R 25/164 174/481 |
| 4,245,880 | A * | 1/1981 | Zimmerman, Jr. | H01R 25/006 439/405 |
| 4,717,350 | A * | 1/1988 | Lax | H01R 25/003 439/488 |
| 4,872,849 | A * | 10/1989 | Long | H01R 25/164 439/209 |
| 4,918,258 | A * | 4/1990 | Ayer | H02G 3/00 174/53 |
| 6,086,397 | A * | 7/2000 | Chapman | H01R 25/003 439/214 |
| 6,752,653 | B1 * | 6/2004 | Morlock | H01R 25/003 439/216 |
| 6,939,180 | B1 * | 9/2005 | Wu | H01R 13/713 439/650 |

(Continued)

*Primary Examiner* — Tulsidas C Patel
*Assistant Examiner* — Peter G Leigh

(57) ABSTRACT

A multi-outlet power strip comprises a channel assembly that includes a front channel having an integrated ground clamp configured to couple a ground wire of a received receptacle harness. In an example embodiment, the ground clamp is disposed at a first end of the channel assembly. A back channel can be mounted at a desired location. Supply wiring from a junction box or other type of power source can be provided to the back channel and coupled to receptacle wiring at a second opposing end of the front channel. The front channel can be coupled to the back channel. A back channel can be configured to engage an angle mount bracket in a manner that allows channel translation and passage of supply wiring. The angle mount bracket can independently support a back channel at an angled orientation while an installer secures the back channel to a mounting surface.

19 Claims, 25 Drawing Sheets

(56) References Cited

U.S. PATENT DOCUMENTS

| | | | | |
|---|---|---|---|---|
| 7,004,786 | B1 * | 2/2006 | Bloom | H01R 13/72 439/142 |
| 7,083,421 | B1 * | 8/2006 | Mori | H01R 13/46 439/574 |
| 7,544,900 | B2 * | 6/2009 | Makwinski | H02G 3/0418 174/480 |
| 7,741,568 | B2 * | 6/2010 | Makwinski | H02G 3/0418 174/480 |
| 8,052,437 | B2 * | 11/2011 | Jiang | H01R 25/003 439/106 |
| 8,172,604 | B2 * | 5/2012 | Byrne | A47B 21/06 439/131 |
| 8,287,305 | B2 * | 10/2012 | Sil | H01R 13/443 439/535 |
| 8,625,255 | B2 * | 1/2014 | Linnane | H02G 3/0608 361/611 |
| 9,088,117 | B2 * | 7/2015 | Rosenblum | H01R 25/006 |
| 2006/0276077 | A1 * | 12/2006 | Mori | H01R 13/447 439/538 |

* cited by examiner

ANGLE BRACKET SYSTEM WITH INTEGRAL GROUND ATTACHMENT

CROSS REFERENCE TO RELATED APPLICATIONS

This application claims priority from U.S. Provisional Application No. 62/158,123, entitled "Angle Bracket System with Integral Ground Attachment" filed May 7, 2015 by David J. Ziobro, which is incorporated herein in its entirety by reference.

FIELD OF INVENTION

This invention relates generally to multiple outlet power strips, and more particularly to a power strip having tamper proof outlets and an integrated ground connection.

BACKGROUND OF INVENTION

Multi-outlet power strips are designed to provide power access to a plurality of electrical plugs. Power strip characteristics, such as size, design, shape, mounting configuration, etc. can vary widely. For example, a small, portable power strip can have a relatively short housing designed to accommodate a small number of plugs via plug apertures closely spaced together. A cord or cable connected to the housing terminates in a plug that can be inserted into an existing wall or floor outlet to expand the number of devices that the pre-existing outlet can serve. The portable power strip can be removed when no longer needed, and reused in an alternate location. Alternatively, a multi-outlet power strip can be installed in a fixed location at a consumer residence, public facility, commercial building, or other site, for example in a floor, at a work station, under a cabinet, etc. Typically, an installed power strip offers several advantages over a portable power strip, such as, but not limited to: having a housing configured to receive and accommodate wiring directly from a junction box, enabling a junction box to serve a plurality of appliances and devices in an aesthetically pleasing manner, obviating the need for an unsightly power cord to dangle from a wall or stretch across a floor to connect with a wall or surface outlet, and reducing the number of openings that must be cut in a wall or floor to deliver electricity to multiple devices simultaneously. At the same time, however, installation of power strips can be time-consuming, with errors or faults in the installation process possibly degrading power strip performance or even rendering a power strip inoperable. Manufacturers who attempt to improve performance, convenience, appearance or ease of installation, are constrained by government and industry standards that regulate power strip design and use. Design modifications and features that have been implemented to improve power strip performance and appearance often fail to have their intended effect, or fail to address all current deficiencies. As a result, presently known power strips continue to suffer one or more disadvantages.

For example, the Underwriter Laboratory (UL) 111 standard requires that a metal enclosure of a power strip be properly connected to a ground wire of incoming supply wiring used to connect outlets or receptacles of the power strip to a power source, such as an electric junction box behind a wall or floor of a building. Existing power strips, such as the Wiremold AL2000 System require an installer to insert a ground clamp in a back channel of the power strip, then loop a ground supply wire around the ground clamp's stud. Having looped the ground supply wire, the installer can then connect the supply ground wire to a ground wire that runs through the power strip receptacles. As an alternative to looping the supply wire around the ground clamp stud, an installer can attach a pigtail wire to the stud, then splice the ground supply wire with the pigtail. The installer may then connect the spliced supply wire with the ground wire running through the several receptacles contained within the front channel. The supply wiring is then folded back into the channel area. The front channel can then be coupled to the back channel, typically through a friction fit in which the two channel portions are snapped together. The front channel is connected to the ground path through its interface with the back channel.

While adequate for its intended purpose, the apparatus and method discussed above have several shortcomings and disadvantages. One disadvantage is the amount of time it takes for an operator to install a power strip. An installer must take time to insert and secure a ground clamp into a back channel of the power strip, insert and pull supply wiring into the back channel, connect the ground supply wire to the clamp, then connect the supply wire to the wiring of a receptacle harness. The back channel offers limited space for pulling the supply wires through, connecting them with receptacle wiring, and storing the supply wiring after the appropriate connections are made. The more difficult the pulling, connecting and storing process is, the longer the installation time will be, and the more costly installation of the apparatus becomes. Efforts to shorten the wiring that is folded and stored within the assembled channel must be exercised with care, as any attempt to shorten the wire necessarily shortens the distance by which the two channel portions can be separated during installation or maintenance. When the wire length becomes too short, which can happen at the ends of a channel, there is no longer enough wire or space between the channel portions to connect the supply wiring with the receptacle wiring. In this situation, an operator typically installs an end supply box to provide additional space to for splicing wires together and storing the folded back wiring. The end feed box can spoil the appearance of the installed outlet assembly, as well as add time and cost to the installation process.

To obviate the need for an installer to physically connect a feed ground wire to a ground clamp, the PlugMold 2000 steel series provides an alternative ground connection. A metallic projection is disposed at the back of each receptacle of a receptacle harness. When the front and back channels are snapped together, the projections are designed to contact the steel enclosure of the back channel to provide a ground connection between the two channels. While possibly conserving some time and space, this apparatus and method have the disadvantage that the projections that extend across and between the two channels prevent wiring from being passed underneath any of the receptacles. In addition, if the front and back channels are not pushed together tightly and completely, the ground projections will not have sufficient contact with the back channel to provide the necessary ground connection.

A further drawback of prior art channel assemblies is that they generally require an installer to hold a back channel in place while securing the back channel to a mounting surface. Underwriter Laboratories 111 Standard 4.6.C. limits mounting holes on a base or base fitting surface to a maximum diameter of 7.1 mm, and limits slotted openings to dimensions no greater than 15.9 mm in one direction and no greater than 3.2 mm in the other dimension. These restrictions prevent inclusion of a keyhole opening on a back channel that could be slipped over a screw in a mounting bracket to hold the back channel in place while an installer inserts and tightens mounting screws.

SUMMARY OF THE INVENTION

In an example embodiment, the present invention provides a system that includes a multi-outlet channel assembly comprising a front channel having a ground clamp; a receptacle harness comprising a plurality of electrically coupled electric receptacles, coupled to the channel assembly; and supply wiring configured to provide electricity to the receptacle harness, received within the channel assembly and coupled to the receptacle harness. A receptacle ground wire coupling the plurality of electrically coupled power receptacles is coupled to the ground clamp at the front channel. An apparatus having a ground clamp in the front channel expedites the installation process and simplifies a front channel ground connection. An installer no longer needs to take the time to insert and secure a ground clamp to the back channel. Instead, insertion of a ground clamp at the front channel can be performed at the manufacturer. Likewise, coupling the receptacle harness to the ground clamp can be performed prior to the installation process, preferably at the factory or at a dealer/retailer prior to an installer's departure out to an installation site. Even when the receptacle harness is coupled to the ground clamp during an installation process, disposition of the ground clamp at the front channel, which is configured to hold the receptacle harness, makes coupling the receptacle ground wire with the ground clamp quick and easy, and independent of the back channel. By way of example, a receptacle ground wire can be looped around a stud of the ground clamp in the front channel.

In an example embodiment, the ground clamp is disposed at one end of the channel assembly, and the supply wiring is received at an opposing end. With a first end portion of the receptacle ground wire coupled to the ground clamp, an installer can connect the opposing end of the receptacle ground wire to the supply ground wire at the opposing end of the channel assembly. The placement of the ground clamp at a first end of the front channel increases the amount of space available for coupling and storing supply and receptacle ground wiring at the opposing end of the front channel. Likewise, ends of hot and neutral receptacle wires can be coupled to corresponding hot and neutral supply wires at the opposing end of the channel assembly.

An example front channel for a power strip can comprise a front portion at which a ground clamp is disposed; a top portion generally perpendicular to the front portion, extending rearward from an upper edge of the front portion; a bottom portion generally perpendicular to the front portion, extending rearward from a lower edge of the front portion, generally parallel to the top portion; wherein the front, top and bottom portions define a space configured to receive a plurality of electrical receptacles. In an alternative embodiment, a front channel can have a front portion angled with respect to a top and/or bottom portion.

In an example embodiment, the front portion is configured with ribs that can provide support for ground clamp attachment at an inner surface of the front channel. By way of example, the ground clamp can comprise a stud configured for looping by a receptacle ground wire to provide a ground connection for the plurality of electrical receptacles. The front portion can include a plurality of apertures configured to receive the receptacles so that the receptacles are accessible to electronic apparatus external to the channel assembly. In an example embodiment, the ground clamp is disposed at an end of the front channel.

A channel assembly can be mounted flush with a surface or can be mounted at an angled orientation with respect to a surface. In an example embodiment, a channel assembly can be mounted to an angle mount bracket. For example, an angle mount bracket can be used to mount a channel assembly underneath a cabinet. In an example embodiment, an angle mount bracket can be configured with a shorter length than a channel assembly to provide space for an operator to pull supply wiring out from a wall and route the supply wiring to a knockout panel in a back channel. In addition, an angle mount bracket can be configured to allow supply wiring to pass behind it if necessary. In an exemplary embodiment, an angle mount bracket is configured to be secured with screws to prevent loosening and separation of the mounted channel assembly from the mounting surface when a user removes a plug from a power strip outlet with a rocking motion. An example angle mount bracket can be configured with one or more notches that can assist in the mounting process by eliminating the need for an operator to measure distances during the installation process. In an example embodiment, an angle mount bracket and back channel can be configured to engage by a snap-fit connection that enables a back channel to slide along the length of the bracket to a desired location. For example, an angle mount bracket can comprise one or more grooves that can serve as tracks that a back channel can engage and translate within. This aspect of the invention allows the angle mount bracket to support a back channel, freeing the hands of an installer, and allowing him to use both hands to secure the back channel to the angle mount bracket with screws.

An example method of the invention can include providing supply wiring to a back channel of a channel assembly, mounting the back channel, coupling a supply ground wire with a receptacle ground wire coupled to a ground clamp at a front channel, coupling supply hot and neutral wiring to receptacle hot and neutral wiring, and coupling the front and back channels. By way of example, mounting the back channel can comprise mounting the back channel flush with a mounting surface, or, alternatively mounting the back channel at an angle bracket configured to orient the back channel at an angle with respect to a mounting surface.

An example method of mounting a channel assembly with an angle mount bracket can include positioning a back channel at a desired installation location; marking position of back channel mounting holes; drawing lines down from the marked positions; centering a notch of an angle mount bracket at a marked position; while keeping the notch centered, securing the angle mount bracket with one or more mounting screws; preparing a back channel to receive supply wiring; providing supply wiring to the back channel; coupling the back channel to the mounted angle mount bracket; securing the back channel to a mounting surface with mounting screws; coupling supply wiring and receptacle wiring; and coupling a front channel to the mounted back channel.

DETAILED DESCRIPTION OF EXAMPLE EMBODIMENTS

Example embodiments of the invention are presented herein; however, the invention may be embodied in a variety of alternative forms, as will be apparent to those skilled in the art. To facilitate understanding of the invention, and provide a basis for the claims, various figures are included in the specification. The figures are not drawn to scale and related elements may be omitted so as to emphasize the novel features of the invention. Structural and functional details depicted in the figures are provided for the purpose of teaching the practice of the invention to those skilled in the art and are not to be interpreted as limitations. Directional adjectives, such as rearward, forward, and the like are used for teaching and illustrative purposes and are intended to describe example relationships between members and portions of apparatus and systems, rather than absolute directions, as it is understood that apparatus of the invention can be manipulated to face various directions.

Figure 1:
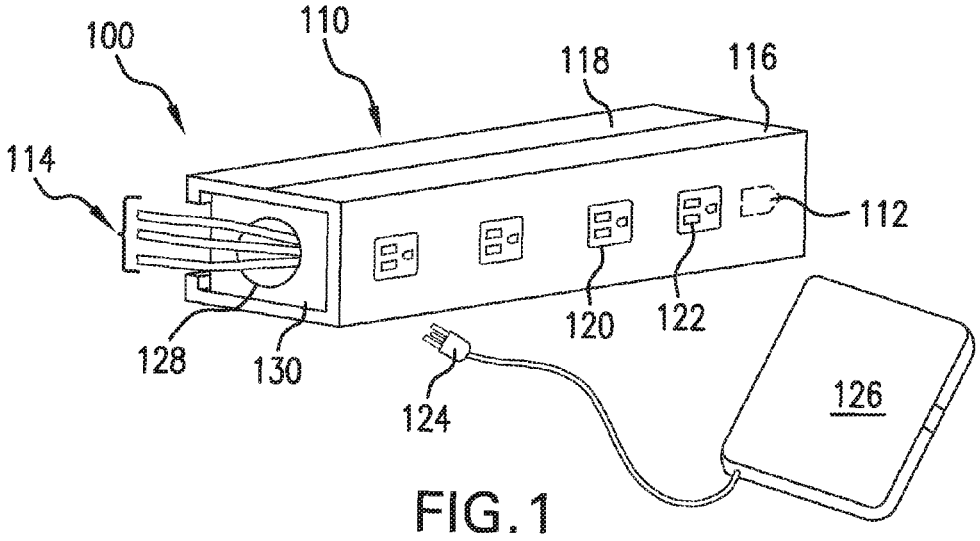
FIG. 1 shows an example system of the invention.

FIG. 1 shows an example system 100 in which a channel assembly 110 having an integrated ground clamp 112 receives supply wiring 114. By way of example, the supply wiring 114 can originate at a junction box coupled to a power grid (not shown) so as to be able to provide electricity to the channel assembly 110. The channel assembly 110 comprises a front channel 116, at which the ground clamp 112 is disposed, coupled to a back channel 118. The ground clamp 112 is depicted in dashed lines to indicate that it is disposed within the interior of the channel assembly 110 and is not visible externally. The front channel 116 includes a plurality of apertures 120 at which electrical receptacles 122 housed within are exposed. The receptacles 122 are configured for receiving a plug 124 of an electrical apparatus 126. In FIG. 1, the electrical apparatus 126 is depicted as a laptop computer. However, the electrical apparatus 126 can be embodied as any of a number of diverse electrical devices and apparatus, such as, but not limited to, various other forms of computing devices, such as desktop computers, tablet or notebook devices, and the like, peripheral devices associated with computing devices, such as a printer, scanner, and the like, fax machines, charging apparatus, kitchen appliances, power tools, etc.

In the example system 100, the supply wiring 114 is received at an aperture 128 in an endcap 130. While not shown in the perspective view depicted in FIG. 1, within the interior of the channel assembly 110, the receptacles 122 are coupled to the ground clamp 112, and to the supply wiring 114. A second endcap (not shown) can be disposed at an opposing end of the channel assembly 110.

Figure 2A:
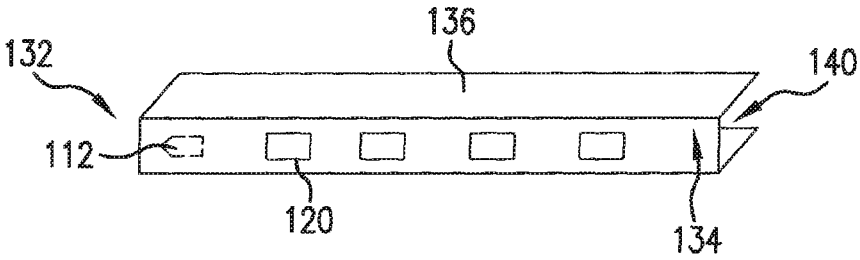
FIG. 2A shows a front view of an example front channel.
Figure 2B:
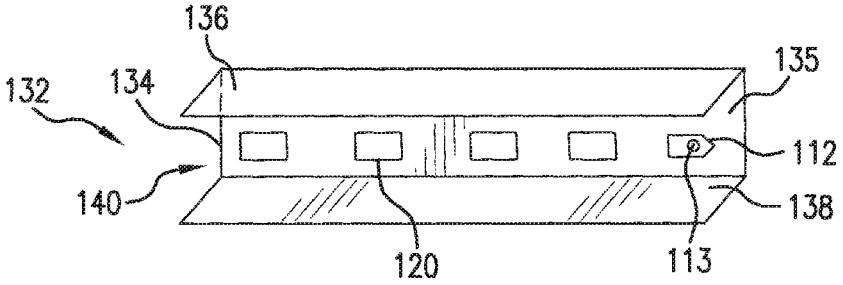
FIG. 2B shows a rear view of an example front channel.

FIG. 2A depicts a front view-of an example front channel 132, where the front view is defined as looking at an external face of the channel, at which plugs from external devices can be received. FIG. 2B, depicts a rear view, defined as looking into the "interior" of the channel, where a receptacle harness can reside. The front channel 132 comprises a front portion 134, a top portion 136 and a bottom portion 138. As shown in FIGS. 2A and 2B, the top portion 136 is configured to extend outward and rearward from the front portion 134. In this example the top portion 136 is shown in a generally perpendicular relationship with the front portion 134, however it is contemplated that in an example embodiment the front portion 134 may be configured to intersect the top portion 136 in a non-perpendicular relationship. Similarly, the bottom portion 138 is configured to extend generally outward and rearward from the front portion 134, in the same direction as, and generally parallel with, the top portion 136. Shown generally perpendicular to the front portion 134, it is contemplated that the intersection between the bottom portion 138 and the front portion 134 may be variously configured and is not limited to being perpendicular. The front portion 134, the top portion 136 and the bottom portion 138 define an "interior" space or trough 140 configured to accommodate a plurality of electric receptacles 122. The apertures 120, configured to receive and/or provide access to receptacles 122, can be disposed in a spaced apart arrangement at the front portion 134. In an example embodiment, apertures 120 can be spaced around 6" apart.

In an example embodiment, the ground clamp 112 is disposed at the interior of the front channel 132, i.e. at interior face 135 of the channel front portion 134, proximate a first end of the channel front portion 134. The ground clamp 112 can be secured to the channel front portion 134 at a factory during the manufacture process in order to provide an integrated ground clamp at the front channel 132. As discussed previously herein, the integrated ground clamp 112 obviates the need for an installer to provide a ground clamp to a channel while at an installation site. However, it is contemplated that the ground clamp 112 can be repositionable and removable. For example, in an example embodiment, the ground clamp 112 can be removed and inserted at a back channel if desired. By way of example, the ground clamp 112 can include a stud 113.

Figure 2C:
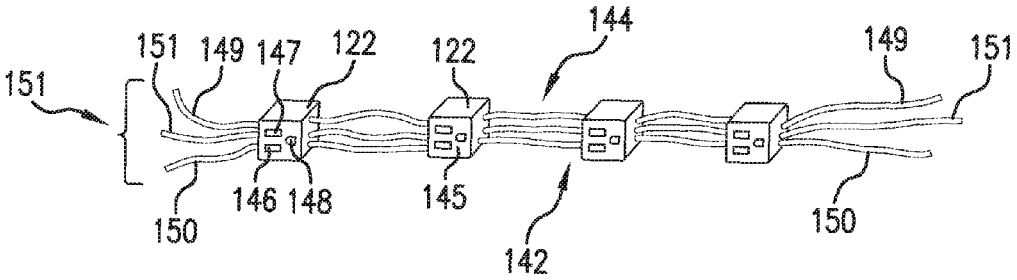
FIG. 2C shows an example receptacle harness for a front channel.

FIG. 2C shows an example receptacle harness 142 comprising a plurality of electric receptacles 122 coupled by receptacle wiring 144. In an example embodiment, the receptacles 122 can be configured with the face plate 145 defining the apertures 146, 147, 148 for receiving tines of an electric plug, such as the electric plug 124. The receptacle 122 can be configured to couple a received tine with an electric terminal (not shown) in order to provide electricity to the electric plug. The receptacle wiring 144 can include a receptacle hot wire 149 (typically black), a receptacle neutral wire 150 (typically white) and a receptacle ground wire 151 (typically green). In an example embodiment, the receptacle wiring 144 is coupled to each of the receptacles 122 of the receptacle harness 142 by insulation displacement contact (IDC) coupling. However, it is contemplated that other forms of coupling the receptacles can be practiced as known in the art.

Figure 2D:
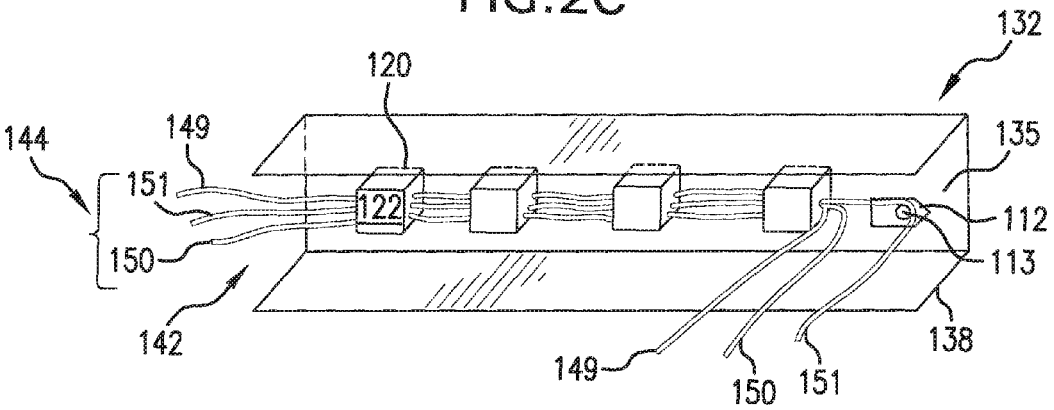
FIG. 2D shows an example front channel coupled to the receptacle harness.

FIG. 2D shows the receptacle harness 142 coupled to the front channel 132. By way of example, but not limitation, a portion of a receptacle 122 can be received at an aperture 120 in order to secure the receptacle 122 in a manner that allows plug prong openings 146, 147 and 148 of the face plate 145 to receive tines of the plug 124, and couple the tines to the appropriate electric terminals. In an example embodiment, a portion of an outer sheath of the receptacle ground wire 151 is stripped to expose a conductor therein. The stripped portion can be looped around the stud 113 of the ground clamp 112 to provide a ground connection between the receptacle harness 142 and the front channel 132. In an example embodiment, coupling the ground wire 151 to the ground clamp 112 can be done at the factory, or alternatively at a dealer, etc. rather than at an installation site.

FIG. 2D shows receptacle wiring 144 extending beyond the plurality of receptacles 122 of the receptacle harness 142. It is preferred that some length of wiring, for example 6"-7", extend from both ends of the receptacle harness 142 in order to (1) provide a sufficient amount of wire at one end to couple supply wiring received at a channel assembly, and (2) provide a sufficient amount of wire at an opposing end to couple a second channel assembly should a second one be required in order to provide a multi-outlet power strip of sufficient length for a desired application. The front channel 132 is configured to accommodate receptacle wiring 144 that extends beyond the receptacles 122 and is folded back into the trough 140.

Figure 3A:
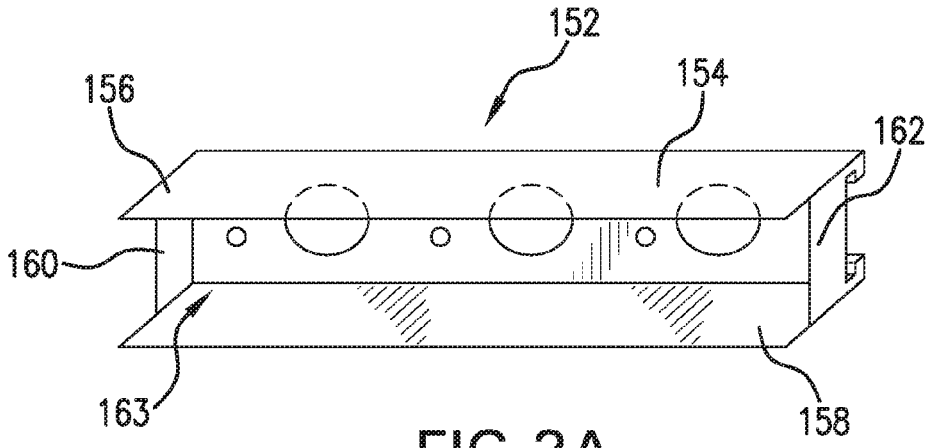
FIG. 3A shows an example back channel.
Figure 3B:
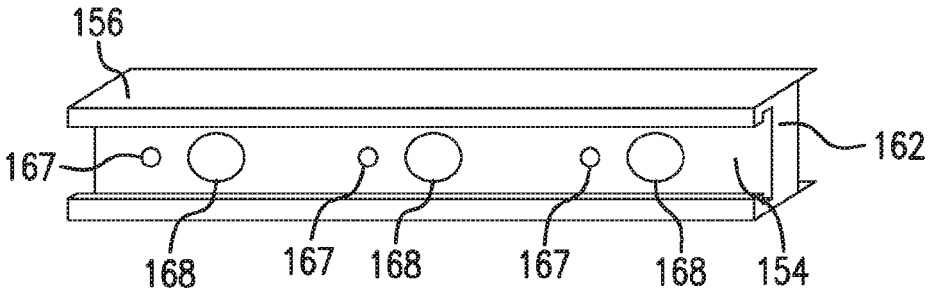
FIG. 3B shows an example back channel.

FIGS. 3A and 3B depict an example back channel 152 which can comprise a rear or back portion 154, a top portion 156, and a bottom portion 158. In an example embodiment, the back channel 152 can further include a first endwall 160 and a second endwall 162; however it is contemplated that a back channel may be configured without endwalls. The top portion 156 can extend outward from the rear portion 154, shown here generally perpendicular to the rear portion 154. Similarly, the bottom portion 158 can extend outward from the rear portion 154, generally perpendicular to the rear portion 154, in the same direction, and generally parallel with, the top portion 156. As discussed above in regard to the front channel 132, the relationship between the rear portion 154 and the top and bottom portions 156, 158 can be something other than perpendicular. In an example embodiment, the first endwall 160 can extend between and adjacent the top portion 156, the back portion 154 and the bottom portion 158 at a first end of the back channel 152, and the second endwall 162 can extend between and adjacent edges of the top portion 156, the back portion 154 and the bottom portion 158 at a second end of the back channel 152. It is contemplated that in lieu of/or in addition to an integrated endwall, the back channel 152 can be configured to receive a removable end fitting that can function as an endwall for a channel assembly. In an example embodiment, the endwalls 160, 162 can extend vertically beyond the top and bottom portions 156 and 158. It is further contemplated, that the endwalls 160, 162 can have a shorter width than the top and bottom portions 156 and 158 so that even with endwalls 160 and 162 present, an end of the back channel 152 is not completely covered by an endwall. A space volume 163 can be defined by the top portion 156, the rear portion 154 and the bottom portion 158 as well as the endwalls 160 and 162, when present.

The back channel 152 can be configured to couple the front channel 132 to provide a channel assembly configured to house the receptacle harness 142 and its associated wiring 144. For example, the back channel 152 can be configured to provide a back wall and endwalls for a channel assembly, while the front channel 132 can provide a front wall for a channel assembly. In an example embodiment, the top portion 136 of the front channel, and the top portion 156 of the back channel are configured to couple, as are the bottom portion 138 of the front channel 132 and the bottom portion 158 of the back channel 152. By way of example, but not limitation, the top portions 136, 156 can be configured to snap-fit together, as can be the bottom portions 138 and 158, to provide a top and bottom for a channel assembly. By way of example, the front channel 132 may comprise a flange configured to engage a recess or lip at the back channel 152, or vice versa, or the channel front and back 132 and 152 can be configured to overlap or couple in an alternative manner. In an example embodiment, the front channel 132 can be configured to receive the endwalls 160, 162 during the coupling process. Thus, the front and back channels 132, 152 can couple to provide and define an enclosed area or channel assembly trough at which the receptacle harness 142 can be housed.

Figure 3C:
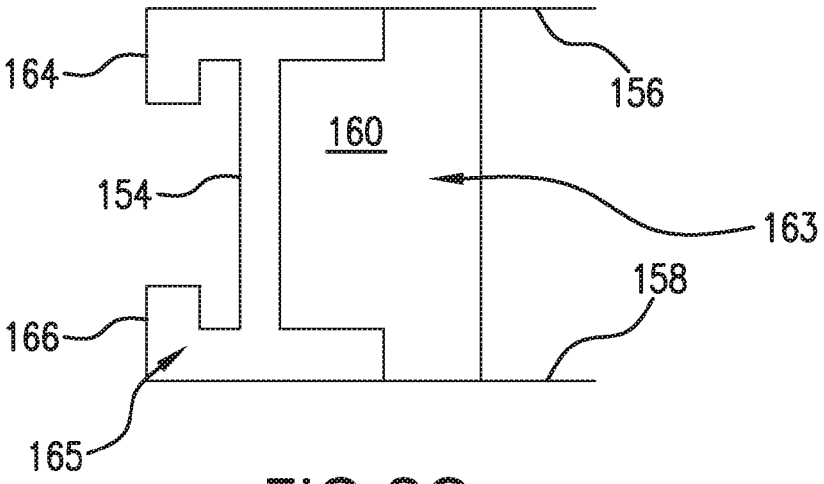
FIG. 3C shows an example back channel.
Figure 3D:
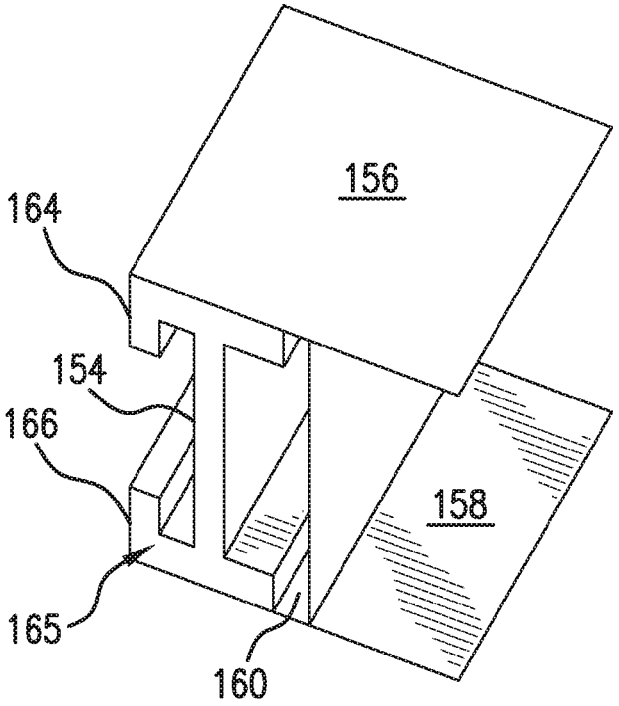
FIG. 3D shows an example back channel.

In an example embodiment, a back channel can be configured to couple an angle mount bracket, for example by having an edge, lip, flange, projection or similar member configured to engage an angle mount bracket. As shown best in FIGS. 3C and 3D, the example back channel 152 can comprise a coupler portion 165 at the rear portion 154. By way of example, the coupler portion 165 can comprise an upper lip 164 and a lower lip 166, with the upper lip extending "downward" from the top portion 156, and the lower lip extending "upward" from the bottom portion 158.

The back channel 152 can be configured for mounting a channel assembly. For example, the rear or back portion 154 can comprise one or more mounting holes 167 which can be used to mount the back channel 152 to a mounting surface such as a wall, floor, desk, work table, counter top, etc. In an example embodiment, the present invention can be configured to provide a mounted angled channel assembly as described in U.S. Pat. No. 8,480,420, entitled "Outlet and Light Assembly with Internal Wiring Connection", issued Jul. 9, 2013 to Ziobro, (Ziobro '420) which is incorporated herein in its entirety by reference. However, other ways of providing an angled assembly will occur to those skilled in the art, for example angling a front portion of a front channel with respect to its top and/or bottom portions. The mounting holes 167, which can be symmetrical or asymmetrical, can be disposed in a spaced apart arrangement across the back portion 154. By way of example, but not limitation, the mounting holes 167 can be disposed 12" apart on center. However, the distance between individual mounting holes 164, and the distance between a series of mounting holes 167 and the first and second endwalls 160, 162, need not be symmetric. In other words, the distance between the first endwall 160 and its most proximate mounting hole 164, may be different than the distance between the second endwall 162 and its most proximate mounting hole. The mounting holes 167 can be variably sized and shaped. In an example embodiment, the mounting holes 167 comply with Underwriters Laboratories 111 standard (clause 4.6.C), and have a maximum diameter of 7.1 mm, and mounting slots are limited to having one dimension no larger than 15.9 mm, and another dimension no larger than 3.2 mm. The mounting holes 167 need not have identical shapes.

The back channel 152 can be configured to receive supply wiring from a junction box or power source. In an example embodiment, the rear portion 154 can comprise one or more knockout portions 168 which can be removed to provide an aperture for receiving supply wiring. Alternatively, an end-wall or endcap of a back channel can comprise an aperture configured for receiving supply wiring, as shown in FIG. 1.

Figure 4A:
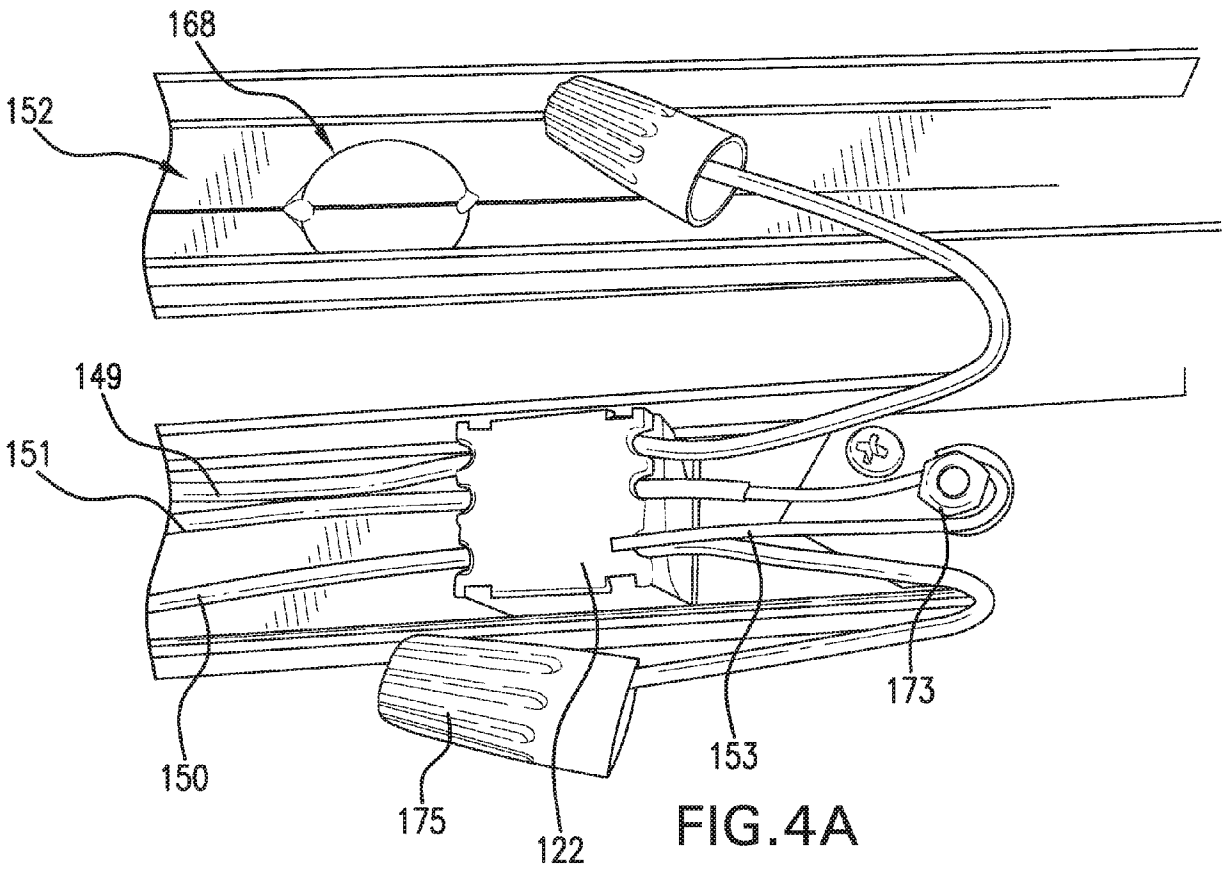
FIG. 4A shows an example front and back channel.

FIG. 4A shows a closer perspective view of the example front channel 132 and the example back channel 152. As can be more readily seen in FIG. 4A, in an example embodiment, the ground clamp 112 can be secured to the front channel 132 by one or more screws 172, shown here on either side of the stud 113. In an example embodiment, the front channel 132 can be configured with ribs (not shown) that can brace the ground clamp 112 against forces caused by insertion of the screws 172 and can prevent their visibility after a channel assembly is installed. In the example embodiment of FIG. 4, a stripped portion 153 of the receptacle ground wire 151 is wrapped around the stud 113. In an example embodiment, the receptacle ground wire 151 can be secured at the stud 113 with a hex nut 173.

Figure 4B:
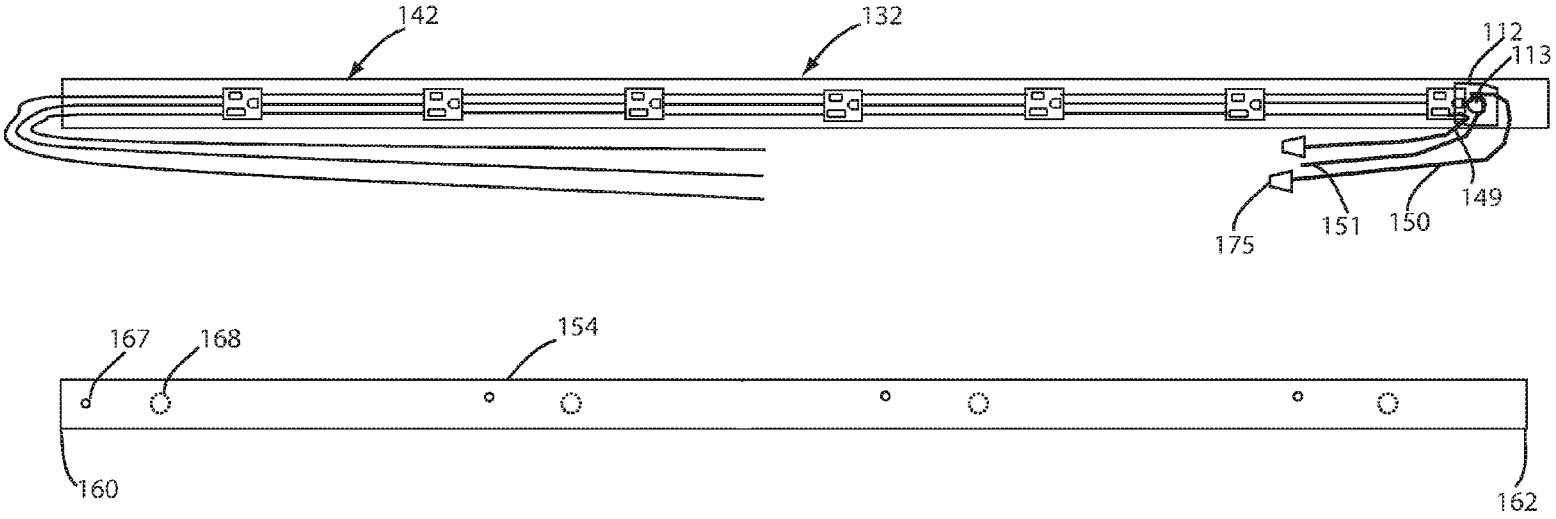
FIG. 4B shows example front and back channels.
Figure 4C:
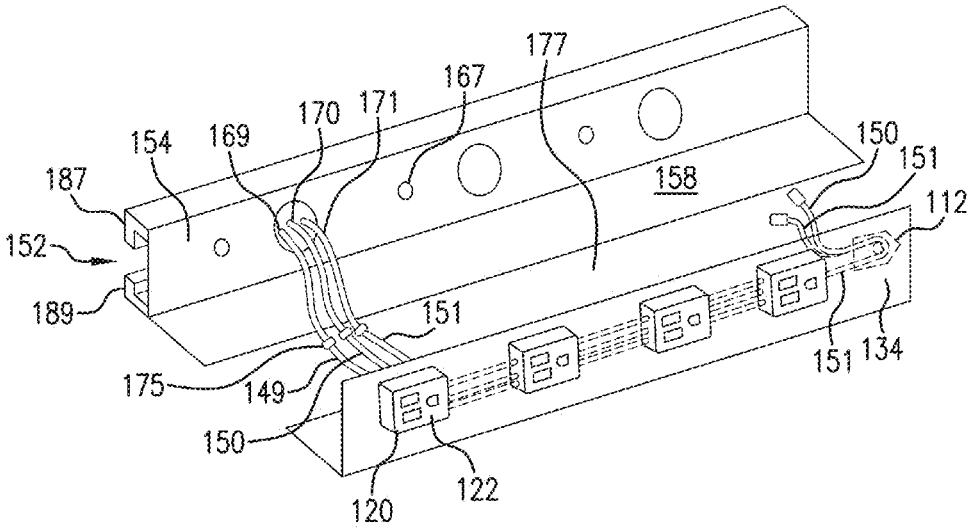
FIG. 4C shows example front and back channels.

As shown in FIGS. 4B, 4C, the remaining length of the looped ground wire 151 can be folded back into the front channel 132, along with the lengths of receptacle hot and neutral wires 149 and 150 that extend from the "last" receptacle of a receptacle harness. As understood herein, a receptacle that is nearest the junction of supply and receptacle wiring, and thus the first receptacle to be provided electricity from that junction, is considered to be the "first" receptacle of the harness. Similarly, the receptacle that is the last receptacle to be fed by electricity that flows through the junction (typically the receptacle farthest from the junction) is identified as the "last" receptacle of the harness. In an example embodiment, about 7 inches of receptacle wiring extend from the last receptacle and are folded back into a front channel. In an example embodiment, the receptacle ground wire 151 can be secured at a clamp, a receptacle housing or other securing means at the front channel 132. The receptacle hot wire 149 and the receptacle neutral wire 150 can be capped with wire nuts 175 or other appropriate wire caps or connector.

FIG. 4C shows the back channel 152 and the front channel 132 with some portions cut away or not shown in order to better illustrate space between channels defined as the channel assembly trough 177. Opposing ends of the receptacle hot wire 149, neutral wire 150 and ground wire 151 can be connected to supply hot wire 169, supply neutral wire 170 and supply ground wire 171 with wire nuts 175 or other appropriate connectors.

Figure 5A:
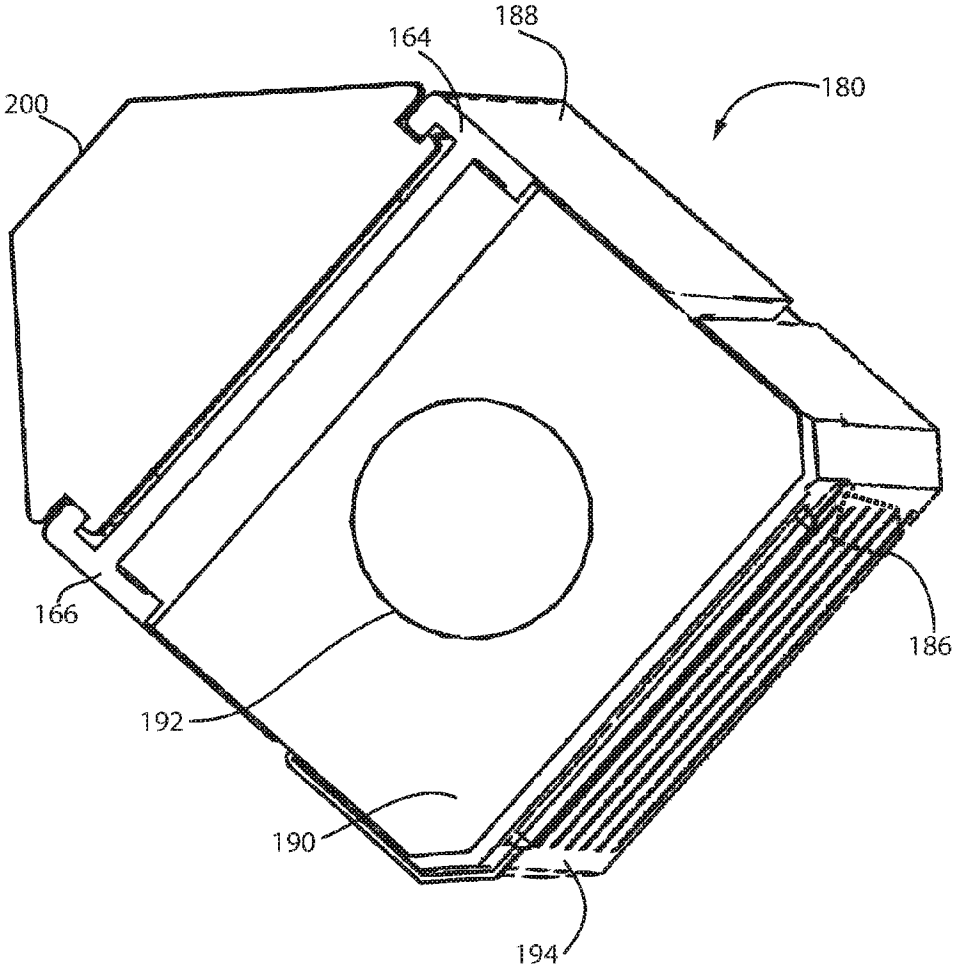
FIG. 5A shows an example angle-mounted channel assembly.
Figure 5B:
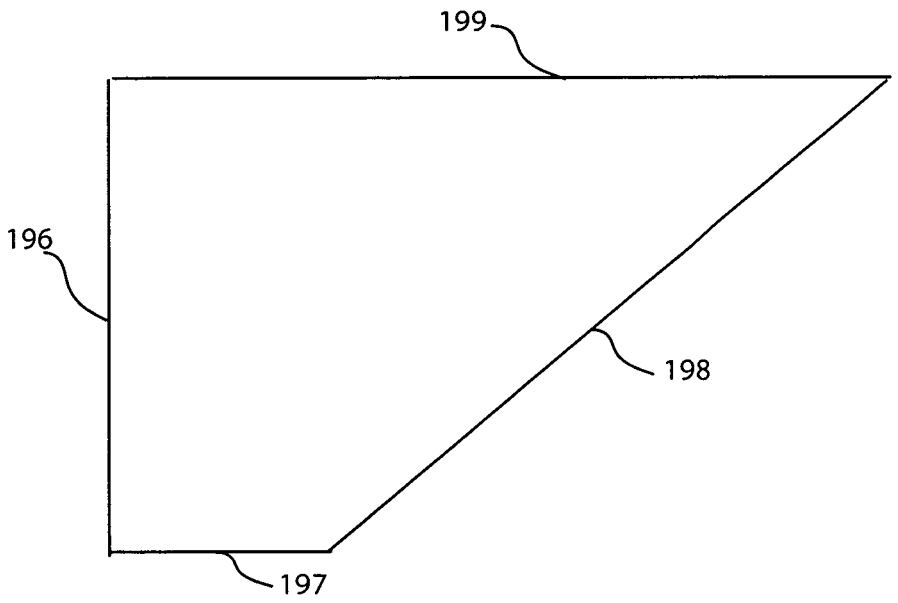
FIG. 5B shows how a channel assembly can be angled.

A channel assembly of the invention can be mounted flush with a surface, and can also be mounted at an angle bracket configured to support the channel assembly at an angled orientation. An angle bracket mount is particularly useful for some applications, for example when a multi-outlet strip is desired underneath a cabinet, counter top, laboratory table, or other structure having an overhang under which the angle bracket can be mounted. FIG. 5A shows an example channel assembly 180 coupled to an angle mount bracket 200. The channel assembly 180 comprises a front channel 184 having an integrated ground clamp 186, and a back channel 188 configured to couple the front channel 184. The channel assembly 180 can be sized and configured to couple the angle bracket 200 and be secured therein at a mounting site. An endcap 190 for the channel assembly 180 includes the aperture 192 configured to receive supply wiring. FIG. 5B shows a possible orientation of a channel assembly, depicting a wall 196, having a thickness 197 of tile and underlayment, and a profile of wood 198 angled with respect to a bottom of a cabinet 199 and the wall 196. In the example embodiment depicted, the angle is 45°.

t is further contemplated that a channel assembly can be configured to provide angled access to receptacles without dependence on an angle bracket. For example, a front channel can have a front portion angled with respect to a top portion and/or a bottom portion, in order to provide a series of outlets having an angled orientation with a surface or overhang. In an example embodiment, the receptacle harness 142 of a channel assembly can comprise a plurality of tamper-resistant receptacles such as those taught by Ziobro '420, previously referenced herein. By way of example, but not limitation, a tamper-resistant receptacle can be configured to prevent contact between an object inserted through the aperture 146 and a receptacle power terminal (not shown) unless an object is simultaneously inserted into the aperture 147. Alternatively, a tamper-resistant receptacle may include slides or shutters that cover faceplate apertures 146, 147 to prevent terminal access therethrough, such as those incorporated in Pass and Seymore tamper-resistant receptacle part number 885TR-W. Other configurations of tamper-resistant receptacles that can be used with the present channel assembly will be apparent to those skilled in the art. It is further contemplated that an channel assembly can comprise a removable mount plate or cover 194 that can conceal the apertures 120 of a front channel, as shown in FIG. 5. The cover 194 can improve the aesthetics of a multi-outlet apparatus as well as prevent access to electric receptacles not currently in use.

Figure 6A:
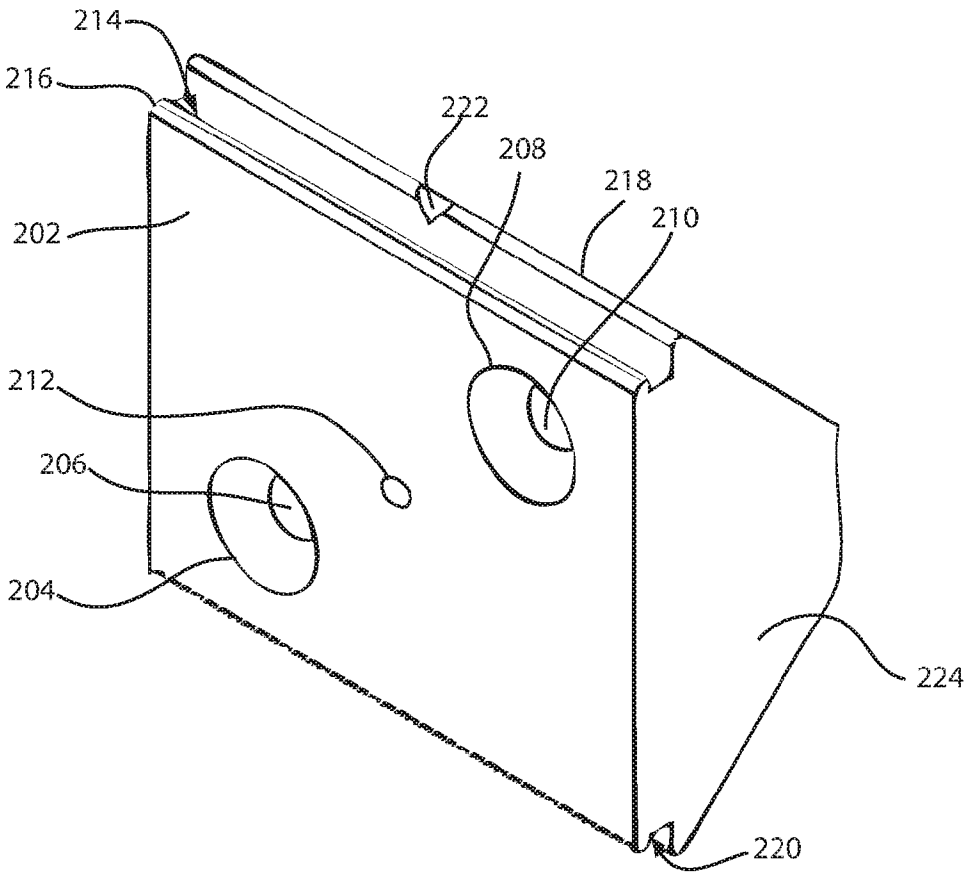
FIG. 6A shows a perspective view of an angle mount bracket.

FIG. 6A shows an example embodiment of the angle mount bracket 200. The angle mount bracket 200 has a front face 202 having a first mounting aperture 204 that leads to a first mounting bore 206, a second mounting aperture 208 that leads to a second mounting bore 210, and a center bore 212. The mounting apertures and mounting bores 204-210 can be configured to receive mounting screws (not shown) for installing the angle mount bracket 200. An upper groove 214 along the top of the angle mount bracket 200 has a first upper groove sidewall 216 and a second upper groove sidewall 218. The angle mount bracket 200 further includes a lower groove 220 at the bottom of the angle mount bracket 200. The upper and lower grooves 214 and 220 can each be configured to receive a flange, lip, projection, or the like of a back channel, and serve as a track, trough or channel that enables translation of a back channel. For example, as shown in FIG. 5A, the back channel 188 can includes the upper lip 164 and the lower lip 166 that can be configured to engage the upper and lower grooves 214 and 220 respectively. In an example embodiment, the angle mount bracket 200 can be configured for snap fit connection with the back channel 188 of the invention and allow translation of the upper and lower lips 164 and 166 along the upper and lower grooves 214 and 220, which can function as tracks for the back channel 188. The grooves 214 and 220 can allow an operator to snap fit the back channel 188 and translate it to the desired mounting position. The angle mount bracket 200 can then support the back channel 188 while an installer uses both hands to secure the back channel to a mounting surface. An upper alignment notch 222 can be disposed at the second groove sidewall 218. As will be discussed in greater detail later herein, the upper alignment notch 222 can be used to obviate the need for an installer to measure distances to determine the proper location for mounting the angle mount bracket to support a channel assembly in a desired channel assembly location.

Figure 6B:
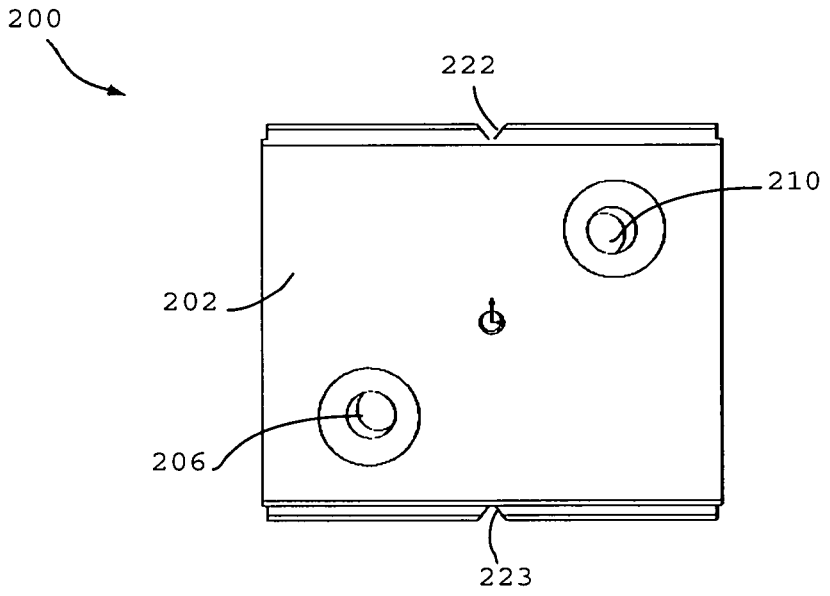
FIG. 6B shows a front view of an angle mount bracket.

In the perspective view depicted in FIG. 6A, a first bracket endwall 224 can be seen. FIG. 6B shows a front view of the angle mount bracket 200, in which the apertures 204, 208 and the bores 206 and 210 can be seen, as well as the upper and lower grooves 214 and 220. As shown in FIG. 6B, a lower alignment notch 223 is disposed at the lower groove 220. The upper and lower alignment notches 222 and 223 are configured to simplify an installation process by providing alignment points that can obviate the need for an operator to measure distances in order to properly position the angle mount bracket 200, as will be explained in greater detail later herein.

Figure 6C:
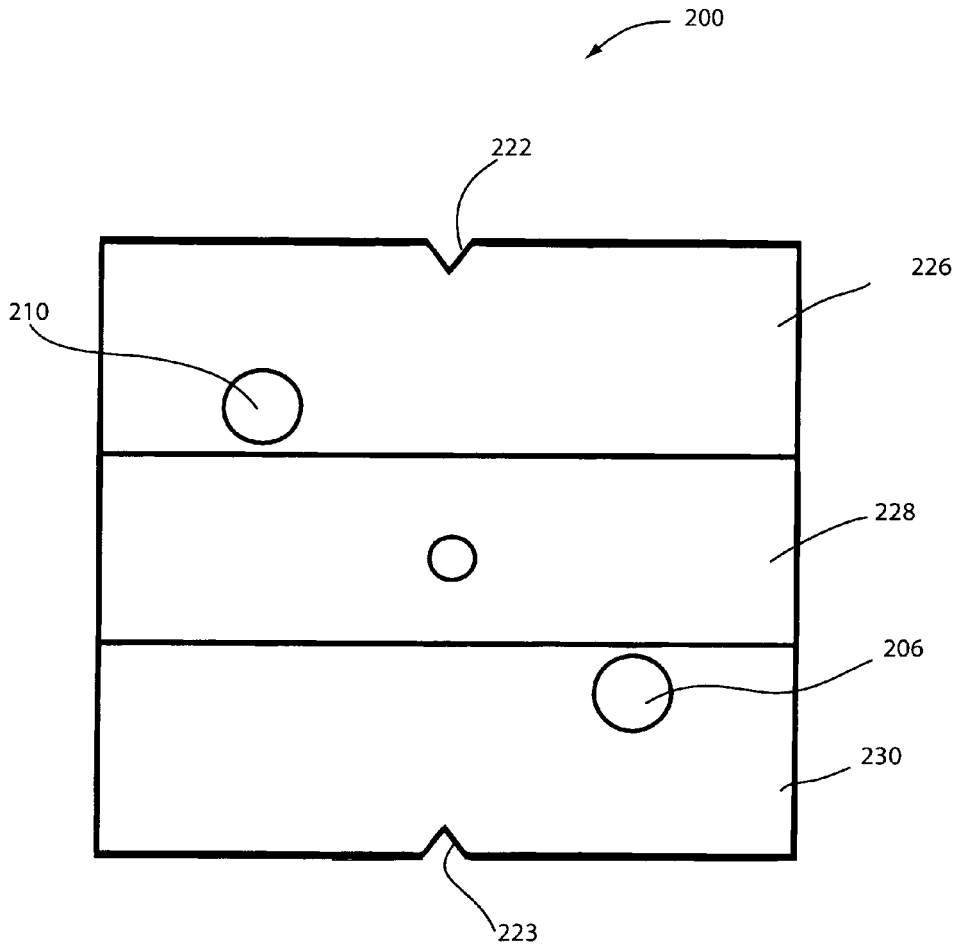
FIG. 6C shows a rear view of an angle mount bracket.
Figure 6D:
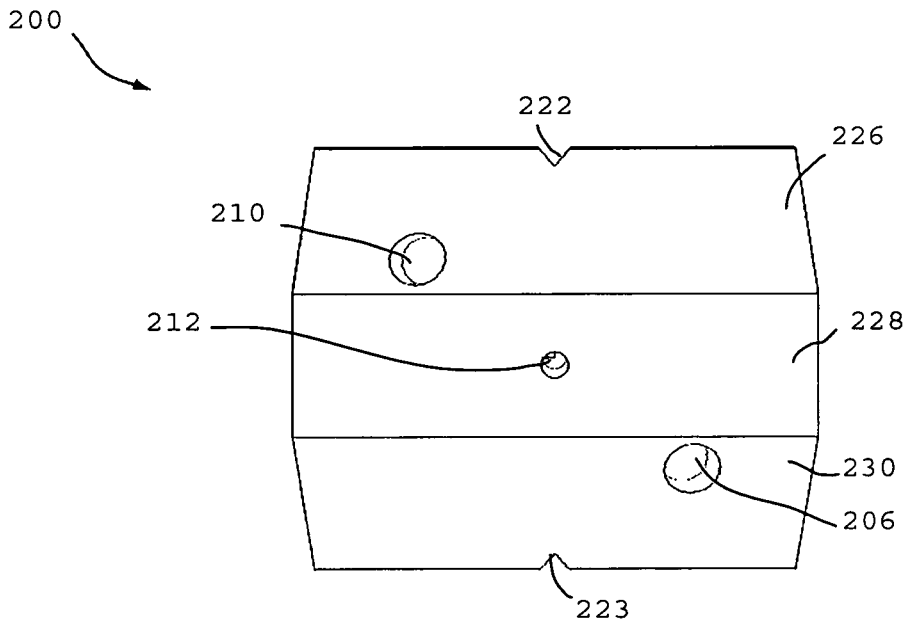
FIG. 6D shows a rear view of an angle mount bracket.
Figure 6E:
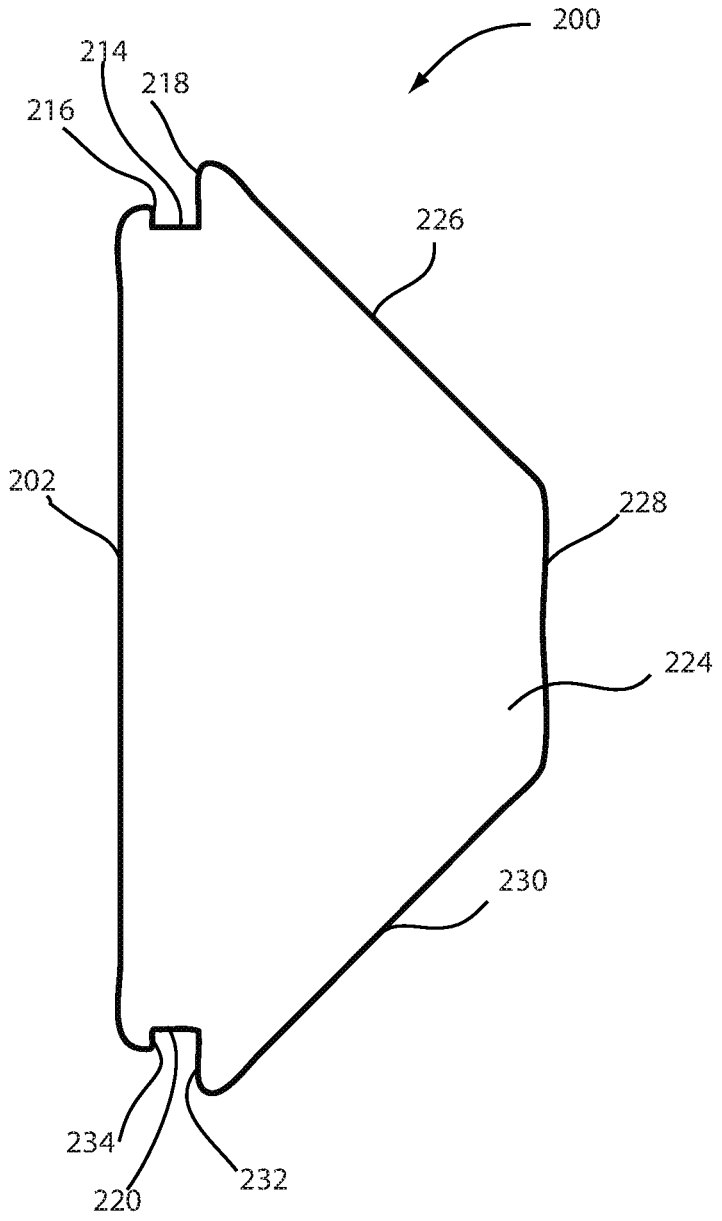
FIG. 6E shows a right view of an angle mount bracket.
Figure 6F:
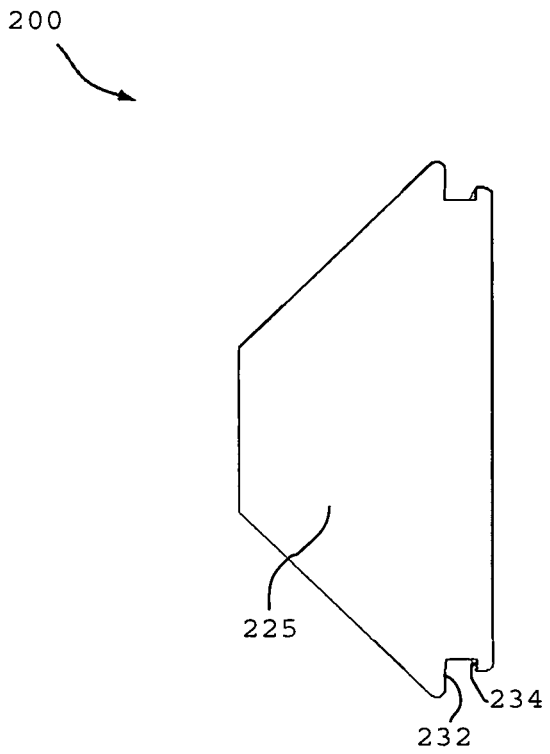
FIG. 6F shows a left view of an angle mount bracket.

FIGS. 6C and 6D show a back view of the example angle mount bracket 200. As can be seen from the figures, the back or rear of the angle mount bracket 200 is not a single planar surface, but rather has three surfaces angled with respect to each other: an upper rear portion 226, a center rear portion 228, and a lower rear portion 230. It is further noted that the upper rear portion 226 and the lower rear portion 230 are angled with respect to the front face 202. The angled relationship can be better observed in FIGS. 6E and 6F which show a right view and a left view respectively of the angle mount bracket 200, and further show a second bracket endwall 225. The first and second lower groove sidewalls 232 and 234 can also be seen in FIGS. 6E and 6F.

Figure 6G:
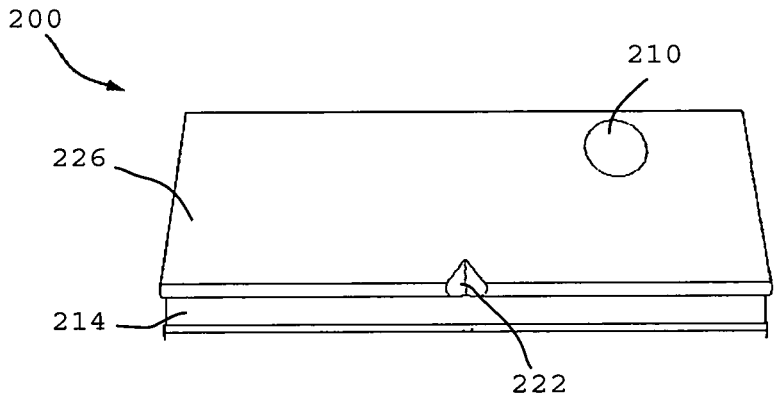
FIG. 6G shows a top view of an angle mount bracket.
Figure 6H:
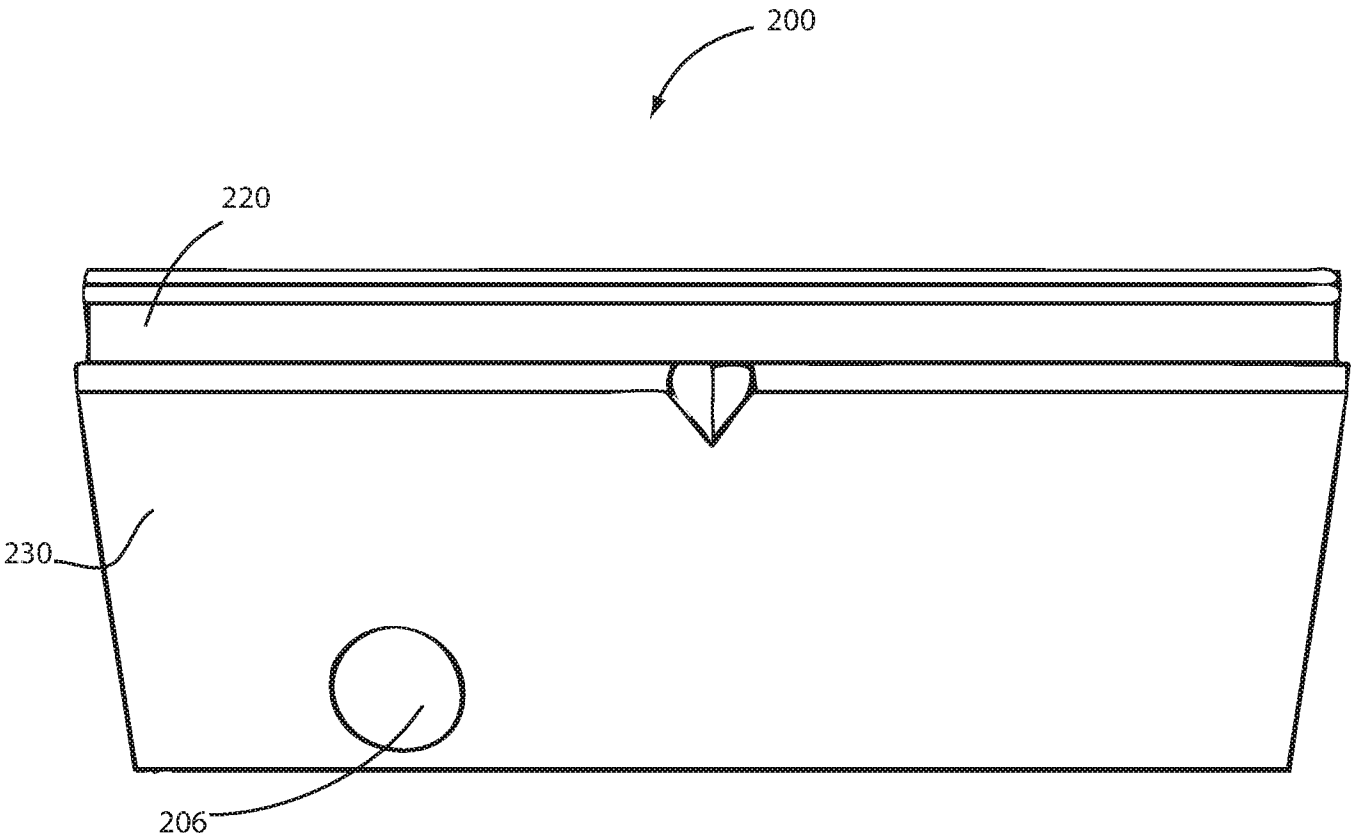
FIG. 6H shows a bottom view of an angle mount bracket.
Figure 6I:
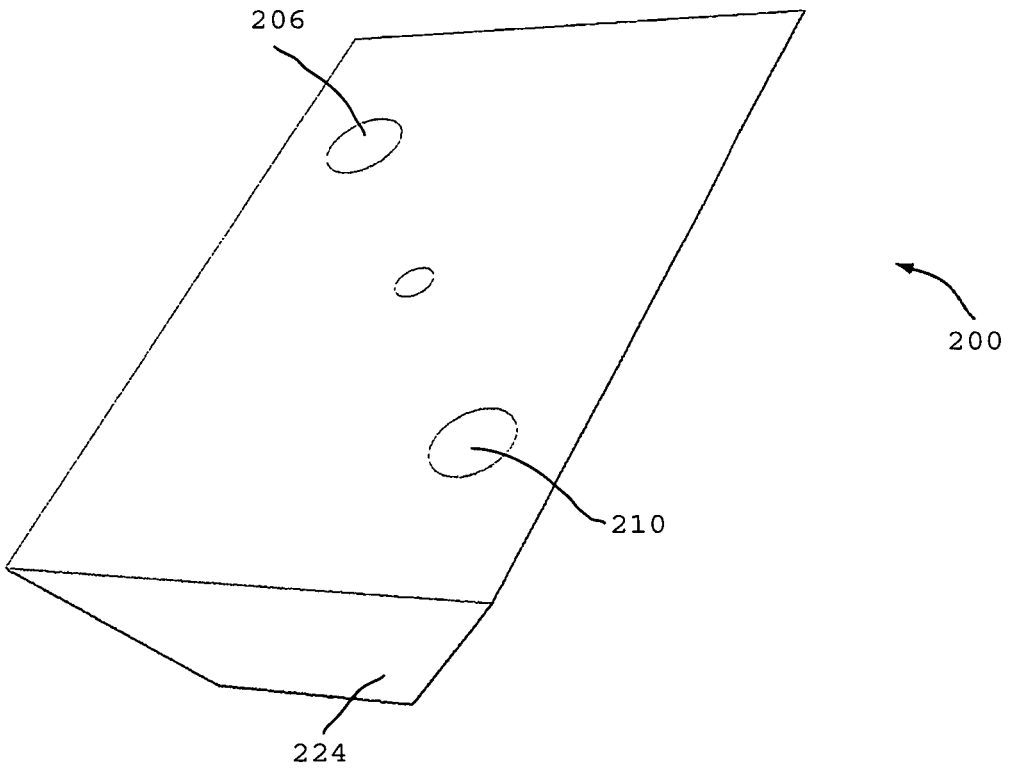
FIG. 6I shows a sectional view of an angle mount bracket.
Figure 6J:
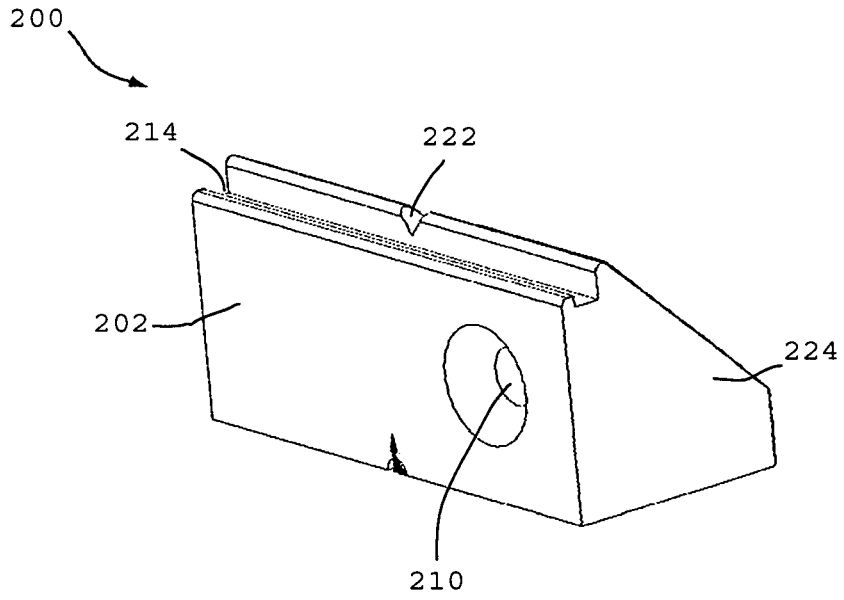
FIG. 6J shows an upper sectional view of an angle mount bracket.
Figure 6L:
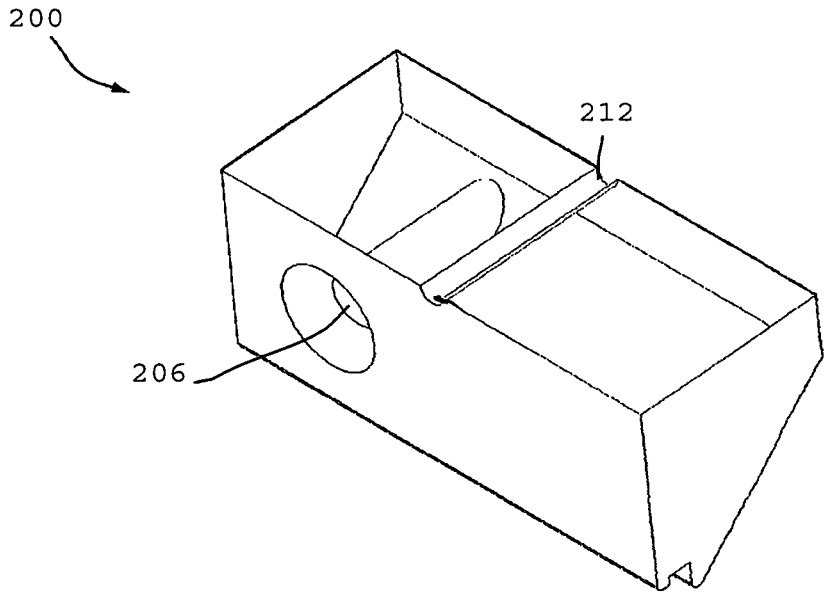
FIG. 6L shows a lower sectional view of an angle mount bracket.
Figure 6M:
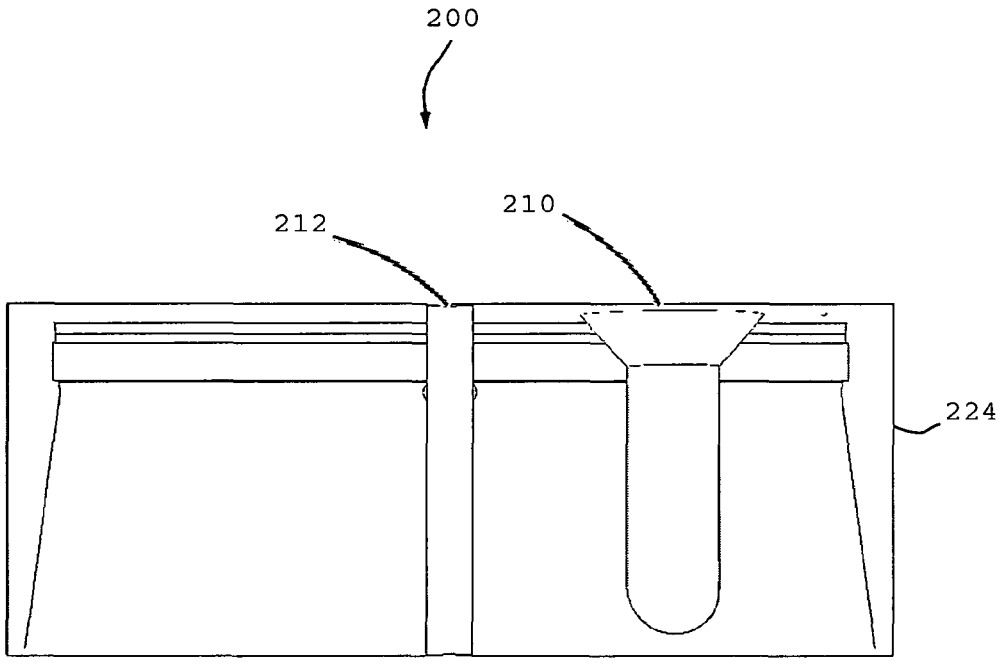
FIG. 6M shows a sectional view of an angle mount bracket.
Figure 6N:
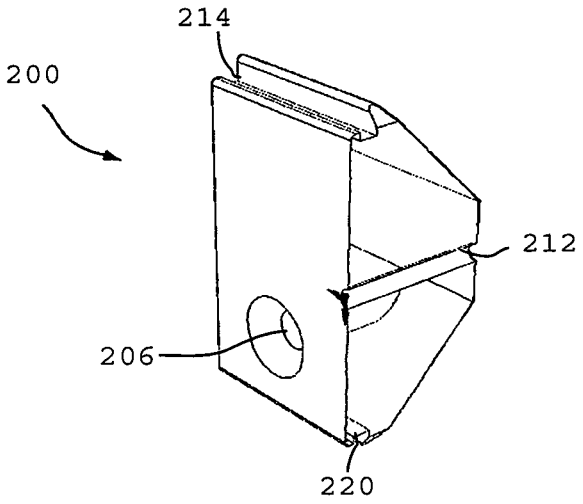
FIG. 6N shows a sectional view of an angle mount bracket.

FIGS. 6G and 6H show top and bottom views respectively of the angle mount bracket 200. The top of the angle mount bracket 200 is essentially the upper groove 214, and the bottom of the angle mount bracket is essentially the lower groove 220. The angled relationships among the upper, center and lower rear portions 226-230 can facilitate supporting a channel assembly at an angled orientation, and can provide space for supply wiring to pass behind a back channel. In an example embodiment, an angle mount bracket can be mounted at a beam below a row of cabinets, as shown in FIG. 5C. The upper and lower grooves 214, 220 are configured to support a channel assembly at the angle at which the front face 202 is oriented.

FIGS. 6I, 6J, 6L-6N show various sectional views of the angle mount bracket 200. As can be seen from the various drawings, the first mounting bore 206, center mounting bore 212 and second mounting bore 210, can extend through the interior of the angle mount bracket 200 from the apertures 204 and 208 in the front face 202 to the back upper portion 226 and lower portion 230 respectively. In an example embodiment, the mounting apertures 204 and 208 have a wider diameter than the mounting bores 206 and 210 to facilitate insertion of mounting screws.

The upper and lower grooves 214 and 220 provide tracks or troughs configured to enable a back channel to slidingly translate in either direction when a back channel is engaged with the angle mount bracket 200 at the grooves 214 and 220. This aspect facilitates mounting a back channel because it enables the angle mount bracket 200 to independently support a back channel, freeing both hands of an operator during channel mounting and installation.

In an example embodiment, the upper and lower grooves 214 and 220 have a shorter length than a coupled back channel, enabling a back channel to extend beyond the first and second endwalls 224 and 225 to provide routing space behind a back channel at either end of the angle mount bracket 200 that can be used to receive and route supply wiring from a wall to the nearest knockout portion in a back channel. Without an angle mount bracket of the invention, supply wiring must either be pulled out of a wall exactly at a knockout location, or an outlet strip must be held away from a wall or mounting surface to create space for pulling supply wiring from its exit from a wall to its entrance at a back channel. As will be discussed in more detail later, in an example embodiment, the angle mount bracket 200 can be mounted in a relationship with a back channel, for example the back channel 188, so that supply wiring can be received within a routing space between the back channel 188 and the angle mount bracket 200 and pulled through a knockout without having to be pulled behind the angle mount bracket 200. In addition to simplifying an installation process, routing space provided by an angle mount bracket of the invention can provide a protective cavity for the supply wiring.

The angled relationships of the upper, center and lower rear portions 226-230, and the truncation of the angle mount bracket 200 at a 90 degree back point, further facilitate routing supply wiring, by enabling wiring to pass behind the front face 202 along either the upper rear portion 226 or the lower rear portion 230. This feature further obviates the need for wiring to be pulled in a narrow space between the back channel and a wall.

The mounting apertures 204 and 208, and the respective mounting bores 206 and 210 can be used to receive mounting screws for mounting an angle mount bracket. Referring to FIGS. 6A and 6D, it can be seen that the bores 206 and 210 are disposed in the upper rear and lower rear portions 226 and 228 in such a way that mounting screws can be received therein to secure the angle mount bracket 200 to a surface without interfering with passage of supply wiring behind the angle mount bracket 200. The mounting bores 206 and 210 are configured to prevent rocking motion of the angle mount bracket 200 when a plug is inserted or removed from an outlet assembly attached thereto.

Figure 7:
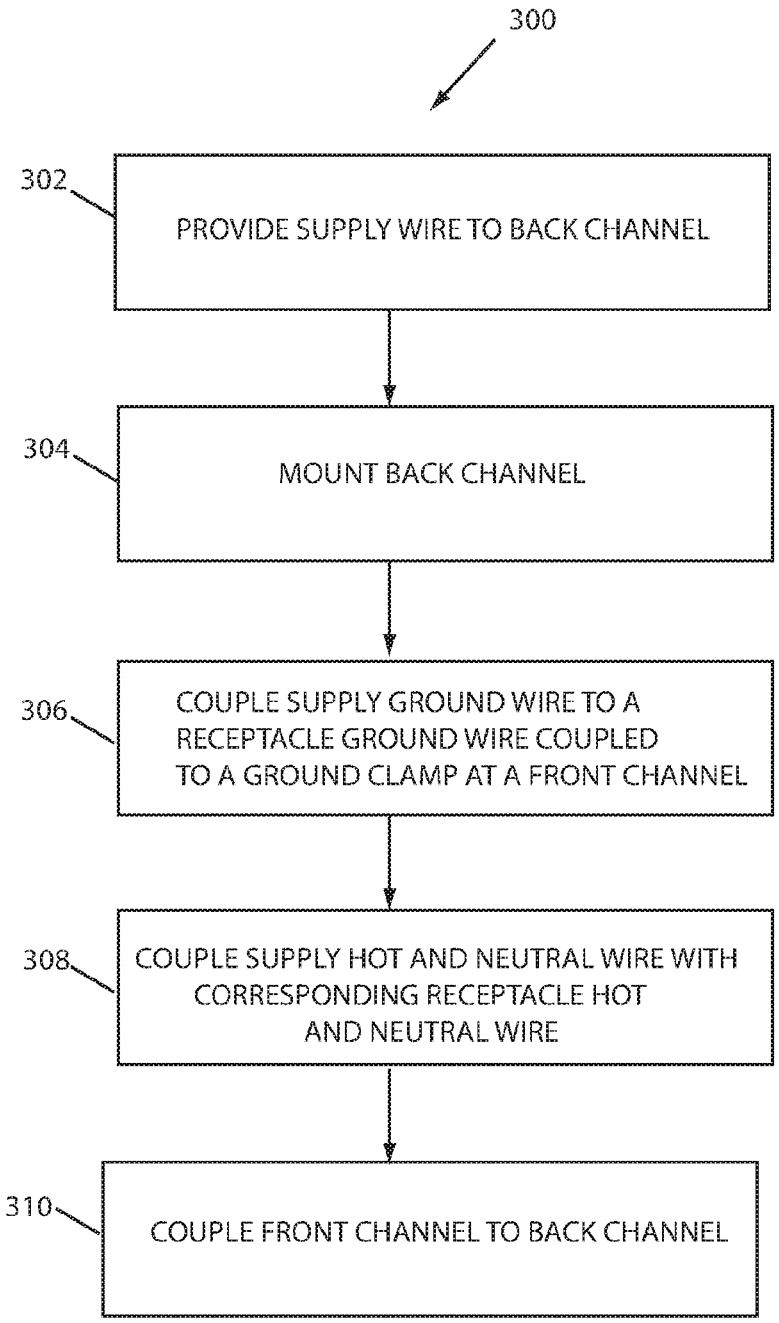
FIG. 7 shows a flow diagram of an example method.

FIG. 7 shows an example method 300 of practicing the invention. At block 302, supply wiring can be provided to a back channel. By way of example, an operator can first prepare a back channel for receiving supply wiring. For example, an operator can remove a knockout 166 of the back channel 152, and insert a cable clamp (not shown) at the back channel 152. (Alternatively, an operator can remove a back channel endcap if supply wiring is to be received from a side rather than from a knockout panel.) The operator can then pull in the supply wiring 114 through the knock out opening and through the cable clamp. At block 304, a back channel can be mounted. In an example embodiment, the back channel 152 can be flush mounted on a flat surface by inserting wood screws or toggle bolts through the mounting holes 167 and tightening them to secure the back channel 152 to the surface. Alternatively, the back channel 152 can be snap fit onto a mounted angle bracket and secured to the mounting surface with wood screws.

At block 306, a supply ground wire can be coupled to a receptacle ground wire that is coupled to an integrated ground clamp at a front channel. For example, using the wire nut 175, an operator can couple the supply ground wire 171 to the end of receptacle ground wire 151 extending out from the first receptacle, near the supply end of the front channel 132. In the short amount of time required to apply the wire nut, grounding of a channel assembly is completed.

Because the ground clamp 112 is integrated at the front channel 132, i.e. provided to the front channel 132 at a factory or dealer, there is no need for an installer to determine the appropriate size of ground clamp required for a channel assembly, and no need for an installer to remember to take an appropriate ground clamp to the installation site.

In addition, there is no need for an operator to take the time to insert and attach a ground clamp at a back channel during an installation process. As a result, the process of grounding a channel assembly and mounting a back channel fed by supply wiring can be performed more quickly than methods that employed prior art apparatus which required provision of a ground clamp to a back channel.

Thus, in the example embodiment described above, after supply and receptacle ground wiring has been coupled, a first end of the receptacle ground wire 151 is coupled to the ground clamp 112, and is folded back into the front channel 132. The second, opposing end of the ground wire 151 is coupled to supply ground wire 171, at an opposite end of the front channel 132, and can be folded into the front channel 132 or the back channel 152 along with the coupled supply ground wire.

Prior art methods and apparatus required an operator couple a supply ground wire to a ground clamp at a back channel, then couple the supply ground wire to an end of a receptacle ground wire. This method required the ground clamp connection and the junction of supply and receptacle ground wiring to all be at the same end of a channel assembly. When the supply ground wire is secured to a ground clamp at a mounted back channel first, it may be difficult or time-consuming for an installer to subsequently connect it to a receptacle ground wire at an unmounted front channel. For example, if more supply wire is needed, the ground connection may have to be undone, more supply wire brought into the channel, and the supply ground connection redone. The same can be said for the case in which too much supply wire is provided to the channel. In addition to simplifying an installation process, the present invention frees up space at the supply end of a channel assembly by eliminating a ground clamp at a feed end of a channel and by obviating the need to provide room to loop a supply wire at a ground clamp.

At block 308, supply hot and neutral wires can be coupled to receptacle hot and neutral receptacle wires. For example, an operator can use a first wire nut 175 to couple the supply hot wire 169 to the receptacle hot wire 149, and use a second wire nut 175 to couple the supply neutral wire 170 with the receptacle neutral wire 150. Thus, all connections between supply and receptacle wiring can reside at one end of a channel, while a ground clamp connection can reside at an opposing end of a channel.

At block 310, front and back channels can be coupled to provide a channel assembly. In an example embodiment, feed and receptacle wiring can be folded into the mounted back channel 152 or the front channel 132. Then the front channel 132, along with the coupled receptacle harness 142, can be snapped onto the back channel 152. If a second channel assembly is to be coupled, the capped receptacle wiring extending from the last receptacle can be pulled out of the front channel 132 rather than being folded into the interior of the first channel assembly. This allows the receptacle wiring to be coupled to receptacle wiring of a second channel. It is noted that supply wiring has been discussed herein in the context of wiring that originates at a junction box and is fed or provided to a back channel. It is understood that supply wiring can also refer to wiring from a first channel assembly coupled to a junction box or power source, that is provided to a second channel assembly. If two channel assemblies are to be coupled, it is recommended that the respective back channels be coupled together first, before prior to performing the actions described above for the method 300.

Figure 8:
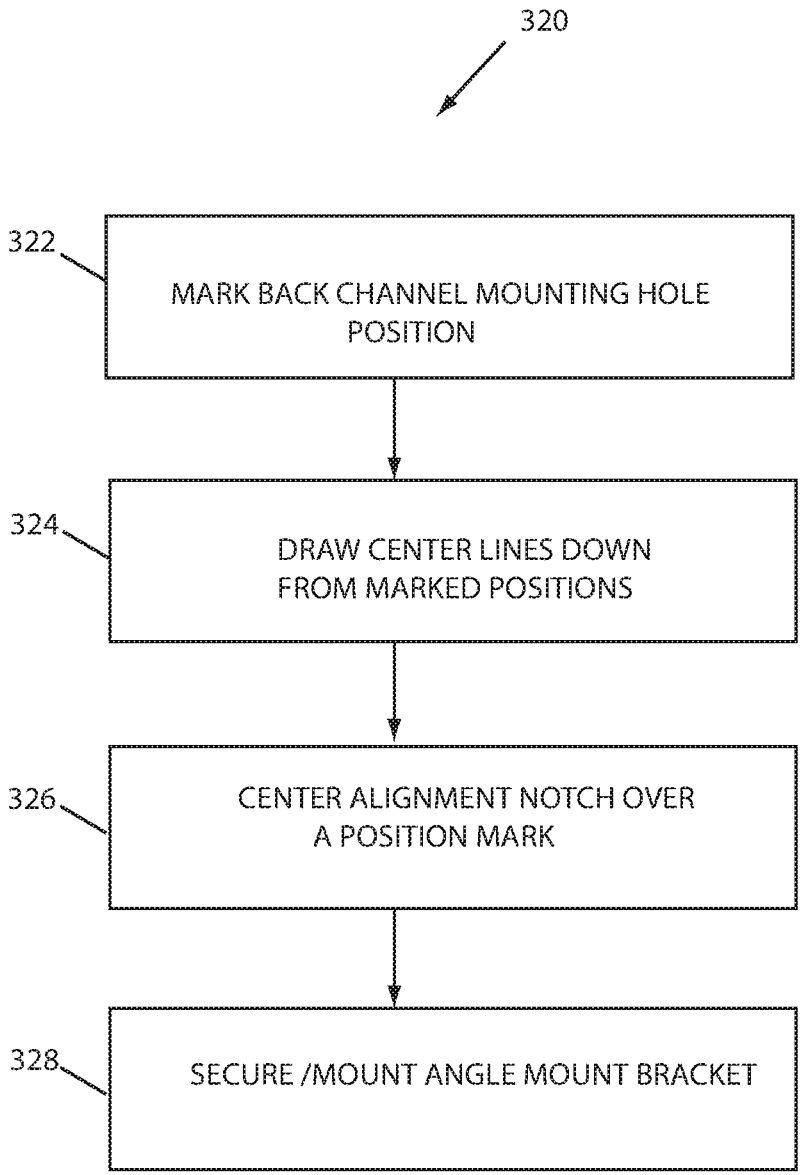
FIG. 8 shows a flow diagram of an example method.

In an exemplary embodiment, a channel assembly is mounted to an angle mount bracket. FIG. 8 shows a flow diagram of an example method 320 for mounting an example angle mount bracket. At block 322, back channel mounting hole positions can be marked. For example, the back channel 188 can be positioned with its back portion 154 against a wall at a desired installation location, and an operator can insert a pencil into each of the mounting holes 167 to mark their center locations on the wall. At block 324, center lines can be drawn from the mounting hole marks. For example, an operator can use the angle mount bracket 200 as a square to draw straight lines downward from each of the mounting hole marks, extending down to the end or edge of the angle mount bracket.

At block 326 a notch of an angle mount bracket can be aligned with a channel mounting hole position mark. For example, an operator can center the upper notch 222 over a mounting hole mark. A notch of an angle bracket provides an easy alignment tool that allows an installer to quickly and accurately position an angle bracket mount in a proper location relative to a desired channel assembly position without having to perform any measurements, such as measuring distances between mounting holes of a bracket and those of a channel. Given the symmetry of the angle mount bracket 200, either the upper notch 222 or the lower notch 223 can be selected. In an example method, an operator can check to see that the other (unselected) notch is centered at the line drawn down from the mounting hole at block 324 to ensure that the angle mount bracket is held straight. In addition, it is contemplated that the center bore 212 can be used during this alignment process. For example, an operator can check to see whether the center bore 212 is centered over the line drawn down from the back channel mounting hole mark. By centering an angle bracket notch at a back channel mounting hole position mark, angle bracket mounting apertures are positioned for properly mounting the angle bracket with respect to a desired back channel location.

At block 328, an angle mount bracket can be secured/mounted. For example, keeping the upper notch 222 centered on the channel mounting hole mark, an installer can insert a first mounting screw into the first mounting aperture 204 of the angle mount bracket 200, and insert a second mounting screw into the second mounting aperture 208. The two mounting screws can then be tightened to secure the angle mount bracket 200 to a mounting surface, for example, a back wall or cabinet lip. In an example embodiment, mounting screws can be embodied as wood screws. Blocks 326-328 can be repeated for each of the mounting holes marked at block 322.

Figure 9:
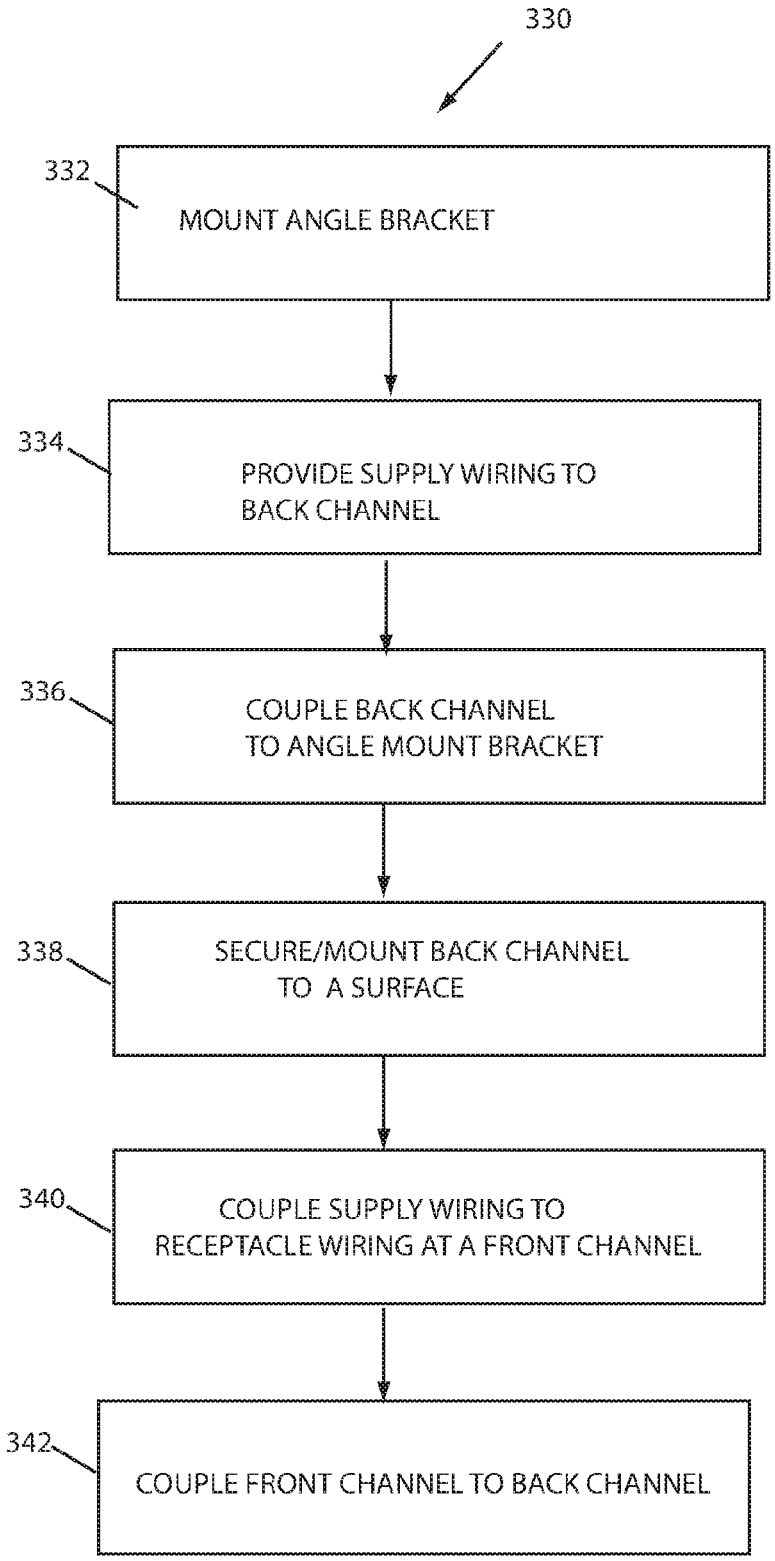
FIG. 9 shows a flow diagram of an example method.

FIG. 9 depicts a flow diagram for an example method 330 for mounting a channel assembly with an angle mount bracket. At block 332 an angle mount bracket can be mounted. For example, the angle mount bracket 200 can be mounted on a backwall as described in method 320 depicted in FIG. 8. At block 334, supply wires can be provided and secured to a back channel. For example, the supply wiring 114 can be pulled out through a hole in the backwall 152, and pulled into the back channel 188 through the knockout 168. At block 336, a back channel can be coupled to a mounted angle mount bracket. For example, the back channel 188 can be mounted to the mounted angle bracket 200 by inserting upper lip 187 into the upper groove 220, and rotating the back channel 152 as necessary to snap lower lip 189 into the lower groove 220. At block 338, a back channel can be secured to a mounting surface. For example, the coupled back channel 188 can be supported by the angle mount bracket 200 while an installer inserts mounting screws, such as wood screws, through the mounting holes 167. At block 340 supply wiring can be coupled to receptacle wiring. For example, the supply ground wire 171 can be coupled to the receptacle ground wire 151 that is looped around the ground clamp 112 in the front channel 132 with a wire nut 175. Similarly, the supply hot wire 169 can be coupled to the receptacle hot wire 149 with a wire nut 175, and the supply neutral wire 170 can be coupled to the receptacle neutral wire 150 with a wire nut 175. At block 342 a front channel can be coupled to a back channel. For example, the front channel 184 can be snap-fit to the back channel 188. In an example method, a cover 194 can be snap fit to the mounted channel assembly 180 to cover exposed receptacles thereof.

Thus the invention provides a system, apparatus and method for a multi-outlet channel assembly that can be quickly mounted at an installation site. A front channel is configured with an integrated ground clamp, obviating the need for an installer to provide one during an installation process. Preferably, the integrated ground clamp is disposed at a first end of the front channel, and the channel assembly is configured to accommodate coupled receptacle and supply wiring at a second end. The invention provides a channel assembly having a ground connection that is both quick and reliable. In addition, a channel assembly of the invention provides protected space behind a back channel for accommodating supply wiring. A channel assembly of the invention provides more room for coupling and storing supply and receptacle wiring, making an installation process easier for an installer. A front channel is configured to couple a back channel to provide a channel assembly that can provide a plurality of outlets that can be variably oriented with respect to a mounting surface.

An angle mount bracket can be used to orient a channel assembly at an angle with respect to a surface. An angle mount bracket can be configured to cooperate with a back channel to provide a protective space for receiving supply wiring from a wall or junction box and routing it to a back channel. In an example embodiment, an angle mount bracket is configured with upper and lower grooves configured to receive a back channel and allow the back channel to slide or translate to a desired location. In addition, the upper and lower grooves enable the angle mount bracket to independently support a back channel so that an installer can use both hands to secure the back channel to a mounting surface. An example angle mount bracket can include upper and lower notches configured to align the bracket with a desired channel mount location so that both can easily be mounted in a manner that neither interferes with the other, without requiring an installer to measure distances between their respective mounting holes.

As required, illustrative embodiments have been disclosed herein, however the invention is not limited to the described embodiments. As will be appreciated by those skilled in the art, aspects of the invention can be variously embodied. Drawings of example embodiments presented herein are not necessarily drawn to scale, and are not to be considered limiting, as some aspects may have been omitted so at to better emphasize particular novel aspects. Methods are not limited to the particular sequence described herein and may add, delete or combine various steps or operations. The invention encompasses all systems, apparatus and methods within the scope of the appended claims.

The invention claimed is:

1. A multi-outlet apparatus, comprising:

a receptacle harness comprising a plurality of electric receptacles electrically coupled one to another by receptacle harness wiring;

a front channel body having a plurality of apertures that receive said receptacles;

a ground clamp attached to said front channel body;

a mountable back channel body;

wherein said front channel body couples said back channel body to provide an assembly;

wherein said receptacle harness wiring is configured to connect to supply wiring originating at a power source;

wherein a ground wire of said receptacle harness wiring is configured to directly couple said ground clamp; and wherein said assembly is configured to accommodate said receptacle harness, said receptacle harness wiring and said supply wiring.

2. The apparatus of claim 1, wherein said back channel body comprises an upper lip configured to engage an angle mount bracket configured to orient the assembly at an angle with respect to a support surface at which said angle mount bracket is coupled.

3. The apparatus of claim 1, wherein said assembly has a longitudinal length, said ground clamp is disposed proximate a first end of said assembly length, and said assembly is configured to receive said supply wiring, configured to provide electricity to said receptacles harness, at an opposing end of said length.

4. The apparatus of claim 3, wherein said supply wiring comprises a supply hot wire, a supply neutral wire, and a supply ground wire.

5. The apparatus of claim 4, wherein, proximate said opposing end, said supply ground wire is coupled to a receptacle ground wire of said receptacle wiring.

6. The apparatus of claim 1, wherein said ground clamp is disposed at an inner surface of said front channel body, entirely at said assembly interior.

7. The assembly of claim 6, wherein said front channel body comprises a front having an outer surface and an inner surface;

a top, extending rearward from an upper edge of said front portion;

a bottom, extending rearward from a lower edge of said front portion.

8. A system, comprising:

A mountable angle mount bracket having a-groove, at least one mounting bore that extends from a front surface through a rear surface, and first and second angled rear portions;

a back channel body coupled to said angle mount bracket at said groove; and wherein at least one of said angled rear portions is configured to provide a routing cavity for supply wiring receivable at said back channel body when said angle mount bracket is mounted at a support surface.

9. The system of claim 8, further comprising a front channel coupled to said back channel to provide an assembly that accommodates a receptacle harness.

10. The system of claim 9, wherein said back channel body is configured to receive supply wiring from a power source.

11. A front channel body for a power strip apparatus, comprising:

a front having an outer surface and an inner surface, and having at least one aperture configured to receive an electrical receptacle;

a top, extending rearward from an upper edge of said front portion;

a bottom, extending rearward from a lower edge of said front portion;

an interior ground clamp attached at said inner surface of said front;

wherein said front, said top, and said bottom of said front channel body define a space configured to receive and accommodate a plurality of said receptacles coupled by receptacle wiring; and wherein said ground clamp is configured to directly couple a ground wire of said receptacle wiring; and wherein entirety of said interior ground clamp is disposed at said inner surface.

12. The front channel body of claim 11, wherein said top is configured to couple a back channel body top, and said bottom is configured to couple a back channel body bottom to provide an assembly configured to house said plurality of electrical receptacles.

13. The front channel body of claim 11, wherein said body has a longitudinal length and said ground clamp is attached to said front at a first end of said length.

14. The front channel body of claim 11, wherein said front is oriented in a non-perpendicular relationship with said top.

15. The front channel body of claim 11, wherein said ground clamp comprises a stud configured for looping by said receptacle ground wire.

16. An angle mount bracket, comprising;

a front face;

an upper rear portion;

a center rear portion;

a lower rear portion, wherein said upper rear portion and said lower rear portion are angled with respect to said center rear portion;

at least one mounting bore, extending from said front face through one of said rear portions, configured for mounting said angle mount bracket at a support surface; and wherein at least one of said rear portions is configured to angle, with respect to a support surface at which said angle mount bracket is mounted, a channel body engaged at said angle mount bracket.

17. The angle mount bracket of claim 16, further comprising an alignment notch at said groove.

18. The angle mount bracket of claim 16, further comprising a second alignment notch at a second groove.

19. The angle mount bracket of claim 16, further comprising a groove disposed between said front face and one of said rear portions.

* * * * *